US008267473B2

(12) United States Patent
Flannery et al.

(10) Patent No.: US 8,267,473 B2
(45) **Date of Patent: *Sep. 18, 2012**

(54) PLASTIC BOOSTER SEAT APPARATUS

(75) Inventors: Mark A. Flannery, Longboat Key, FL (US); Lyle H. Rogalla, Hugo, MN (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/346,581

(22) Filed: Jan. 9, 2012

(65) Prior Publication Data

US 2012/0104816 A1 May 3, 2012

Related U.S. Application Data

(63) Continuation of application No. 12/569,536, filed on Sep. 29, 2009, now Pat. No. 8,091,965.

(60) Provisional application No. 61/195,192, filed on Oct. 3, 2008.

(51) Int. Cl.
*A47D 1/10* (2006.01)

(52) U.S. Cl. ..... 297/256.16; 297/250.1; 297/256.11; 297/256.15

(58) Field of Classification Search ..... 297/250.1, 297/256.11, 256.15, 256.16
See application file for complete search history.

(56) References Cited

U.S. PATENT DOCUMENTS

| | | | |
|---|---|---|---|
| 4,603,903 | A | 8/1986 | Moscovitch |
| 4,854,638 | A | 8/1989 | Marcus et al. |
| 4,867,504 | A | 9/1989 | Johnson |
| 5,094,505 | A | 3/1992 | Nichols |
| 5,183,311 | A | 2/1993 | Meeker et al. |
| 5,474,355 | A | 12/1995 | Lerner et al. |
| 5,516,193 | A | 5/1996 | Simpson |
| 5,609,389 | A | 3/1997 | Longoria et al. |
| 6,015,190 | A | 1/2000 | Wend |
| 6,033,019 | A | 3/2000 | Hession-Kunz et al. |
| 6,773,064 | B2 | 8/2004 | Treen et al. |
| 6,832,813 | B2 | 12/2004 | Tomas et al. |
| 6,929,325 | B1 | 8/2005 | Goelo |
| 7,104,603 | B2 | 9/2006 | Keegan et al. |
| 7,201,445 | B1 | 4/2007 | Dubiel et al. |
| 7,261,380 | B2 | 8/2007 | Ha |
| 7,300,103 | B1 | 11/2007 | Grays |

(Continued)

FOREIGN PATENT DOCUMENTS

| | | | |
|---|---|---|---|
| KR | 20-0147873 | Y1 | 6/1999 |
| KR | 20-0204859 | Y1 | 12/2000 |

OTHER PUBLICATIONS

PCT International Searching Authority, Notification of Transmittal of the International Search Report and the Written Opinion of the International Searching Authority, or the Declaration, Mar. 30, 2010, PCT/US2009/058901.

(Continued)

*Primary Examiner* — Rodney B White

(57) ABSTRACT

A stackable plastic booster seat apparatus with a body having a set of four corner cylindrical portions. A right foot having cylindrical portions engages two of the corner cylindrical portions and a left foot engages the other two corner cylindrical portions. The body includes a back with a lumbar support, a seat with a safety bump and a downward and rearward slope such that a child tends to sit properly in the apparatus away from the safety bump and against the lumbar support.

19 Claims, 15 Drawing Sheets

U.S. PATENT DOCUMENTS

| | | | | |
|---|---|---|---|---|
| 7,387,337 | B2 | 6/2008 | Keegan et al. | |
| 7,673,940 | B2 | 3/2010 | Fritz et al. | |
| 7,695,060 | B2 | 4/2010 | Dubiel et al. | |
| 7,871,125 | B2 | 1/2011 | Asbach et al. | |
| 8,091,965 | B2 * | 1/2012 | Flannery et al. | 297/256.16 |
| 2008/0088162 | A1 | 4/2008 | Fritz et al. | |
| 2010/0244518 | A1 | 9/2010 | Fiore et al. | |
| 2011/0291450 | A1 * | 12/2011 | Gillett et al. | 297/250.1 |

OTHER PUBLICATIONS

PCT International Searching Authority, International Search Report, Mar. 30, 2010, PCT/US2009/058901.

PCT International Searching Authority, Written Opinion of the International Searching Authority, Mar. 30, 2010, PCT/US2009/058901.

* cited by examiner

PLASTIC BOOSTER SEAT APPARATUS

This application is a continuation of U.S. patent application Ser. No. 12/569,536 filed Sep. 29, 2009 (U.S. Pat. No. 8,091,965 issued Jan. 10, 2012) and claims the benefit thereof under 35 U.S.C. §120. U.S. patent application Ser. No. 12/569,536 filed Sep. 29, 2009 claims the benefit under 35 U.S.C. 119(e) of U.S. Provisional Patent Application No. 61/195,192 filed Oct. 3, 2008. U.S. Provisional Patent Application No. 61/195,192 filed Oct. 3, 2008 and U.S. patent application Ser. No. 12/569,536 filed Sep. 29, 2009 are hereby incorporated by reference in their entireties into this application.

FIELD OF THE INVENTION

The present invention generally relates to a booster seat, and specifically to a booster seat that is stackable, includes a lumbar support, and is adjustable in height.

BACKGROUND OF THE INVENTION

A booster seat is a seat for a child that is often intended to be engaged to the seat of an adult chair such that a child may sit at a table at a good height and can better feel a part of the family. Whereas a family makes use of a single booster seat, day care centers, early childhood schools and restaurants may have on hand a great number of booster seats. For example, at a day care center, children may each have their own seat, such as a booster seat, that they can carry from a stack to the story telling area.

Conventional booster seats are problematic. First, conventional booster seats may not be truly stackable. Instead, a stack of booster seats may begin to lean to one side and then collapse, making a mess and wasting time and space that the stacking was intended to conserve.

Second, a booster seat may be one of the first places that a child is introduced to poor posture. A conventional booster seat may include a curved back that extends from side to side of the booster seat or from shoulder to shoulder of the child, somewhat like a child sitting inside of a barrel, on the barrel floor, and leaning against the back of the barrel. This may lead to a "hunchback" type of condition, where the head is down and the shoulders drawn in.

Third, a conventional booster seat may have a seating surface that is in the horizontal plane or that slopes downwardly and frontwardly. Even is the seating surface is disposed horizontally, it is too easy for the child to slide forwardly in the booster seat and against the safety bump. Safety bumps are intended to keep the child in the booster seat, but often are an unpleasant lump in the middle of the seat.

Fourth, if a booster seat is adjustable in height, the height adjustment mechanism is often troublesome to operate or provides an unstable seat. An adjustment height mechanism may be fixed permanently to the booster seat.

SUMMARY OF THE INVENTION

A feature of the present invention is the provision in a molded booster seat apparatus having a molded base, a molded back, and a molded seat, of the molded seat being angled rearwardly and downwardly such that a child sitting in the booster seat is drawn away from a safety bump on the molded seat and toward the molded back.

Another feature of the present invention is the provision in a molded booster seat apparatus having a molded base, a molded back, and a molded seat, of the molded back having a lumbar support such that a child develops good posture and is able to thrust the shoulders back and the head up.

Another feature of the present invention is the provision in a molded booster seat apparatus having a molded base, a molded back, and a molded seat, of the combination of the molded seat having a seat surface angled rearwardly and downwardly and the molded back having a lumbar support such that gravity tends to draw the child away from a safety bump on the molded seat and against the lumbar support.

Another feature of the present invention is the provision in a molded booster seat apparatus having a molded base, a molded back, and a molded seat, of the molded base having four corner portions and of a first foot and a second foot, where the first foot engages two of the corner portions at the same time, where the second foot engages two of the corner portions at the same time, and where each of the first foot and the second foot are disengagable from the corner portions.

Another feature of the present invention is the provision in a molded booster seat apparatus having a molded base, a molded back, and a molded seat, of each of the corner portions having an at least partially cylindrical inner surface, of each of the first foot and the second foot having at opposite ends thereof an at least partially cylindrical outer surface for engaging the at least partially cylindrical inner surface of one of the corner portions.

Another feature of the present invention is the provision in a molded booster seat apparatus having a molded base, a molded back, and a molded seat, of each of the corner portions having an at least partially cylindrical outer surface, of each of the first foot and the second foot each having at opposite ends thereof an at least partially cylindrical inner surface for engaging the at least partially cylindrical outer surface of one of the corner portions.

Another feature of the present invention is the provision in a molded booster seat apparatus having a molded base, a molded back, and a molded seat, of a molded foot engaging the base, of one of a) the molded body and b) the molded foot including at least two slots, of the other of a) said molded body and b) said foot including at least one slot, of the at least two slots being oriented vertically relative to each other, of at least one slot being alignable with each of said at least two slots, and of a piece engagable between one of the at least two slots and the at least one slot such that the molded body is adjustable in height.

Another feature of the present invention is the provision in a molded booster seat apparatus having a molded base, a molded back, and a molded seat, of the molded base, the molded back and the molded seat being integral and one-piece with each other.

Another feature of the present invention is the provision in a molded booster seat apparatus having a molded base, a molded back, a molded seat, a molded first foot, and a molded second foot, of the molded base, the molded back and the molded seat being integral and one-piece with each other, of the first foot being integral and one-piece, and of the second foot being integral and one-piece.

Another feature of the present invention is the provision in a molded booster seat apparatus having a molded base, a molded back, a molded seat, a pair of molded feet, of the apparatus being stackable with and without the molded feet.

Another feature of the present invention is the provision in a molded booster seat apparatus having a molded base, a molded back, and a molded seat, of the height of the seat being increased and decreased not by an adjustment of the seat itself, but by an adjustment of the molded base.

An advantage of the present molded booster seat apparatus is stackability. In other words, a stack of two, three, four, five or more of the molded booster seat apparatus rises straight and true, with minimal if any leaning. One feature providing this advantage is the cylindrical corner portion. Another feature providing this advantage is that the cylindrical corner portion extends from just beyond 180 degrees to 360 degrees.

Another advantage of the present molded booster seat apparatus is that it develops good posture. One feature contributing to this advantage is the lumbar support. Another feature contributing to this advantage is the molded seat that angles downwardly and rearwardly, drawing the child against the lumbar support.

Another advantage of the present molded booster seat apparatus is height adjustability. The seat of the apparatus can be adjusted to a higher level. A booster seat apparatus with a seat that is adjustable maximizes the chances that a child's feet will reach the floor when the child is in a sitting position, thereby providing a safer booster seat apparatus.

Another advantage of the present molded booster seat apparatus is cost. The molded booster seat apparatus is relatively inexpensive to manufacture, a factor leading to a lower cost for the consumer. The molded booster seat apparatus is formed of plastic, a factor leading to a lower cost for the consumer.

Another advantage of the present molded booster seat apparatus is ease of use. With the lumbar support, a child is more likely to have a straight back and upright shoulders, making it easier for a caregiver to lift a younger child out of the apparatus. With the lumbar support, a child's shoulders are back and well positioned such that an older child may push himself or herself out of the seat more easily and safely. Since the apparatus is relatively light, a child can readily carry the apparatus.

Another advantage of the present molded booster seat apparatus is cleanliness. The smooth surfaces of the molded booster seat apparatus makes it less likely to retain dirt and easy to clean. These smooth and easy-to-clean surfaces are found both on the exterior and interior of each of the body of the apparatus and the feet of the apparatus.

Another advantage of the present molded booster seat apparatus is that "one size fits all." In other words, one given molded booster seat apparatus seats comfortably and in good posture about an eight month old child, to about an 18 month old child, to about a two year old child. Features that contribute to this advantage include the height or vertically adjustable feet and the downwardly and rearwardly ramped seat that pulls the child's back against the lumbar support.

DETAILED DESCRIPTION

Figure 1:
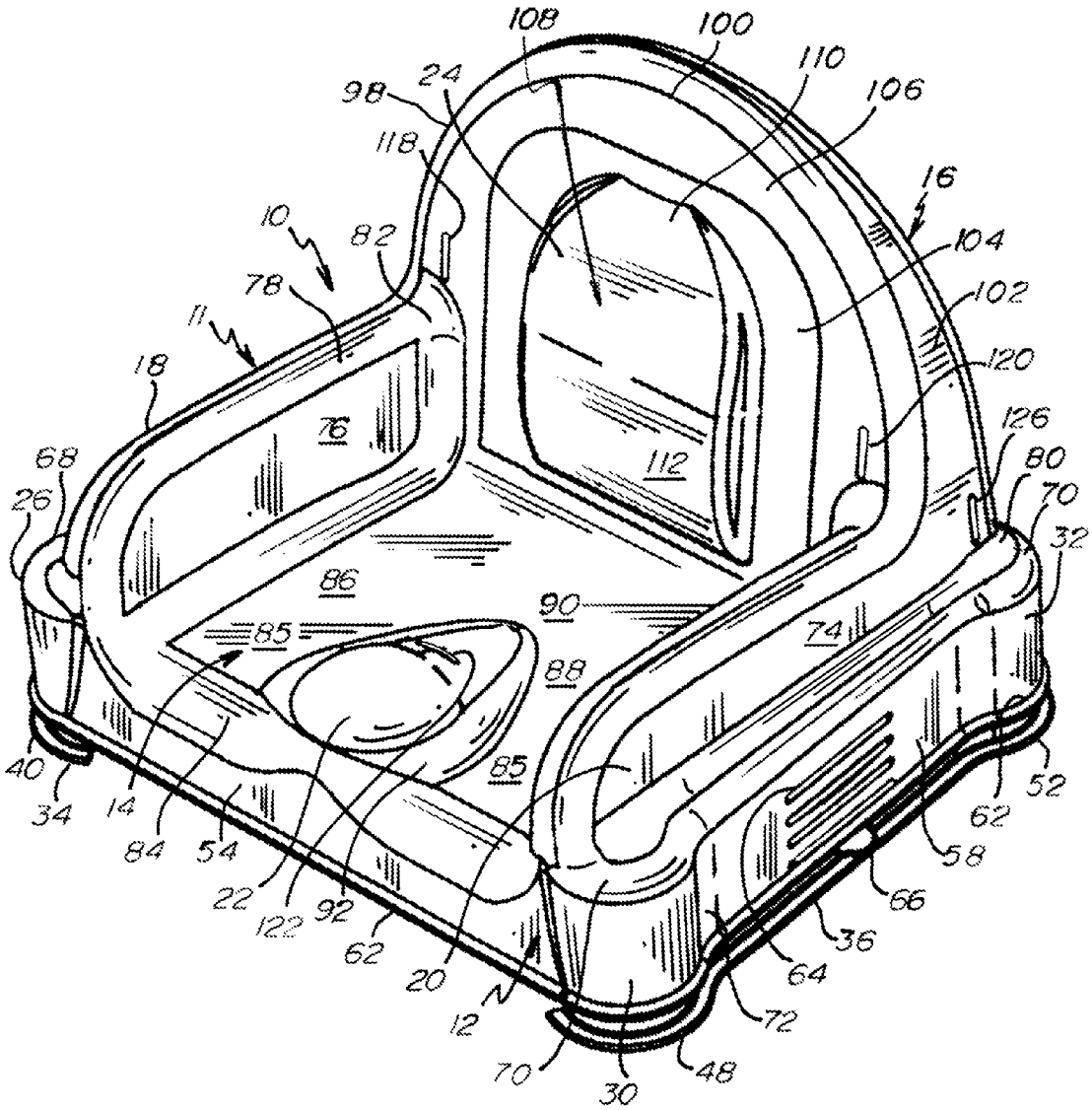
FIG. 1 is a perspective view of the present booster seat.
Figure 4A:
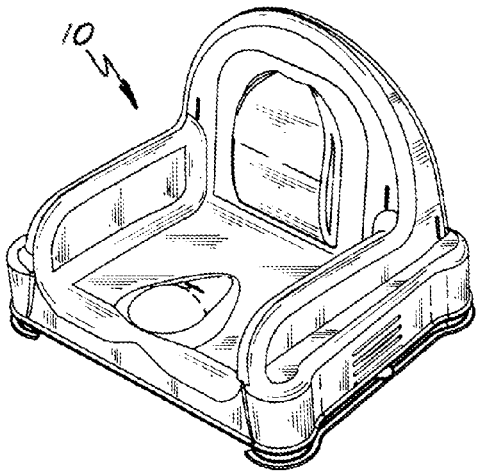
FIG. 4A is a perspective view of the booster seat of FIG. 1 reproduced on a smaller scale for comparison to the top orthographic view of FIG. 4B.
Figure 4B:
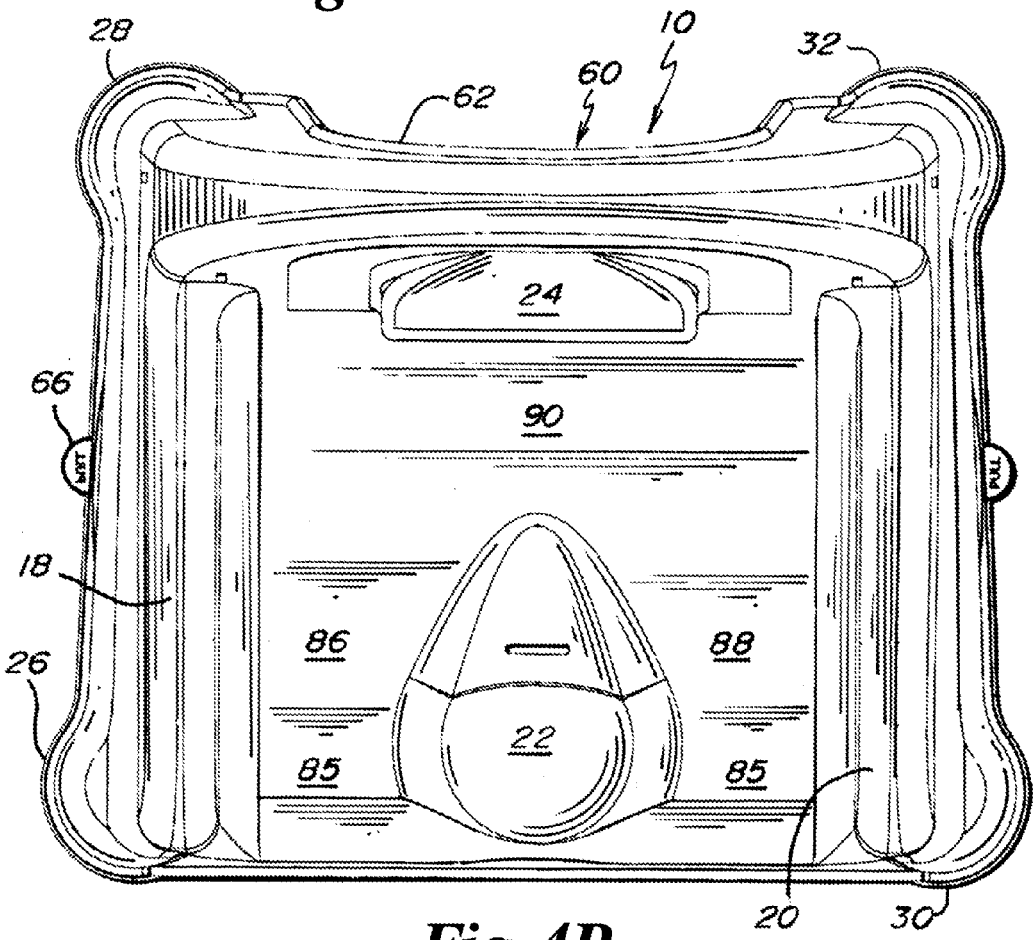
FIG. 4B is a top orthographic view of the booster seat of FIG. 4A.

As shown in FIG. 1, the present plastic molded booster seat apparatus 10 includes a plastic molded body 11. Body 11 includes a base 12, a seat 14, a back 16, a right side arm 18, and a left side arm 20. Seat 14 includes a safety bump 22. Back 16 includes a lumbar support 24. Base 12 includes a right front corner portion 26, a right rear corner portion 28 (shown in FIG. 4B), a left front corner portion 30 and a left rear corner portion 32. Base 12, seat 14, back 16, side arms 18, 20, safety bump 22, lumbar support 24, and corner portions 26, 28, 30 and 32 are integral and one-piece with each other, as are all features of the body 11.

Figure 7A:
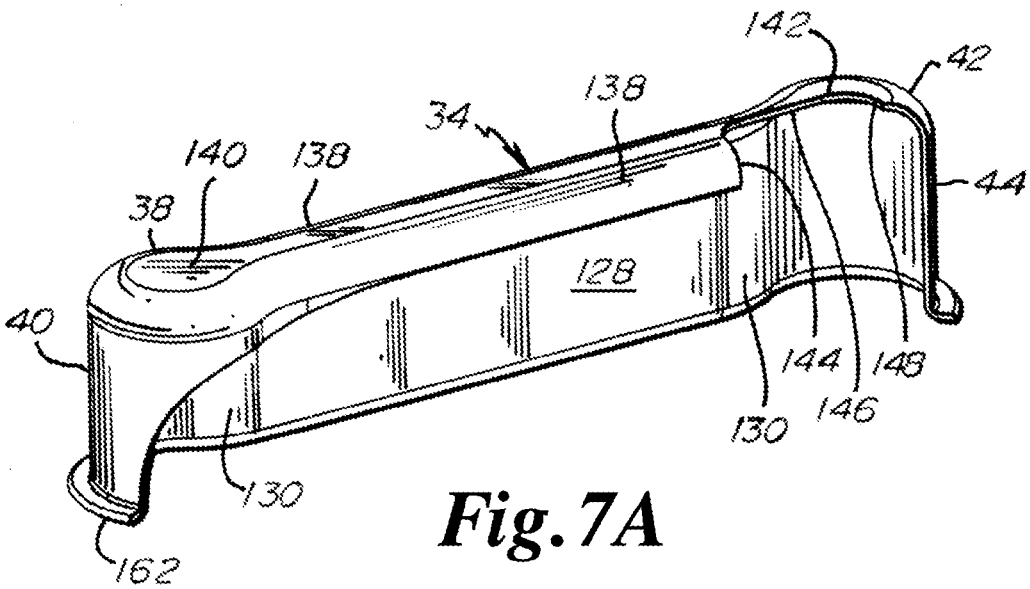
FIG. 7A is a perspective view of the right side foot of the booster seat of FIG. 1.
Figure 7B:
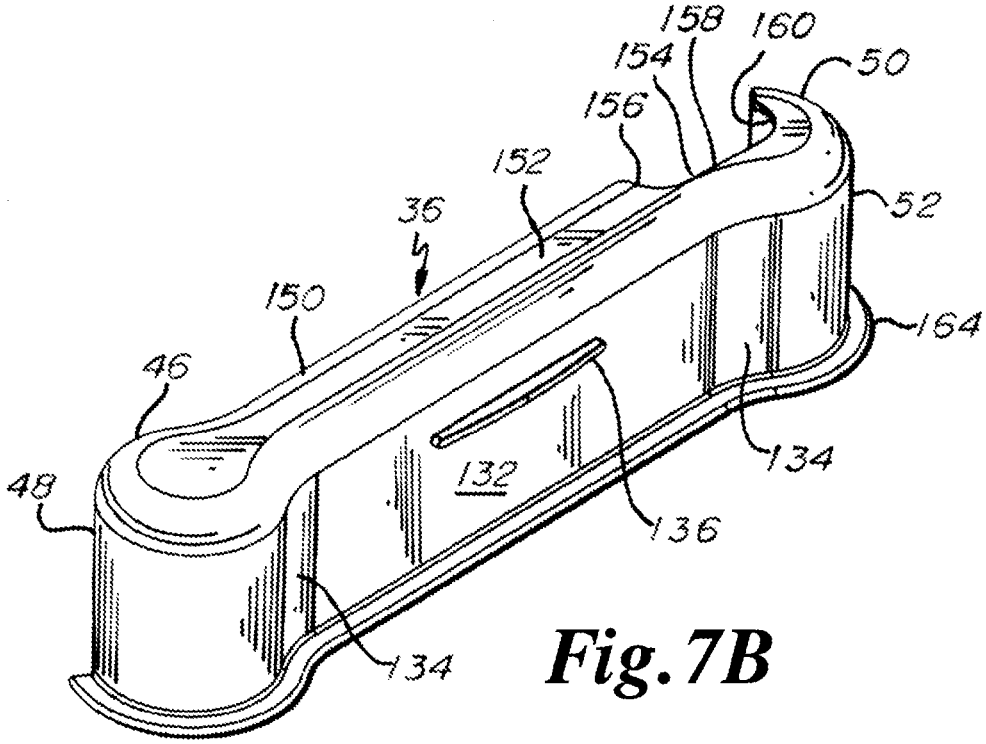
FIG. 7B is a perspective view of the left side foot of the booster seat of FIG. 1.

Plastic molded booster seat apparatus 10 further includes a separately molded right foot 34 and a separately molded left foot 36, as shown in FIGS. 7A and 7B. Right foot 34 includes a front end 38 having an at least partially cylindrical corner portion 40 and a rear end 42 having an at least partially cylindrical corner portion 44. Left foot 36 includes a front end 46 having an at least partially cylindrical corner portion 48 and a rear end 50 having an at least partially cylindrical corner portion 52. Right foot 34 is integral and one-piece. Left foot 36 is integral and one-piece. Right foot 34 can be engaged and disengaged to base 12. Left foot 36 can be engaged and disengaged to base 12. Right foot 34 and left foot 36 are mirror images of each other.

Figure 8A:
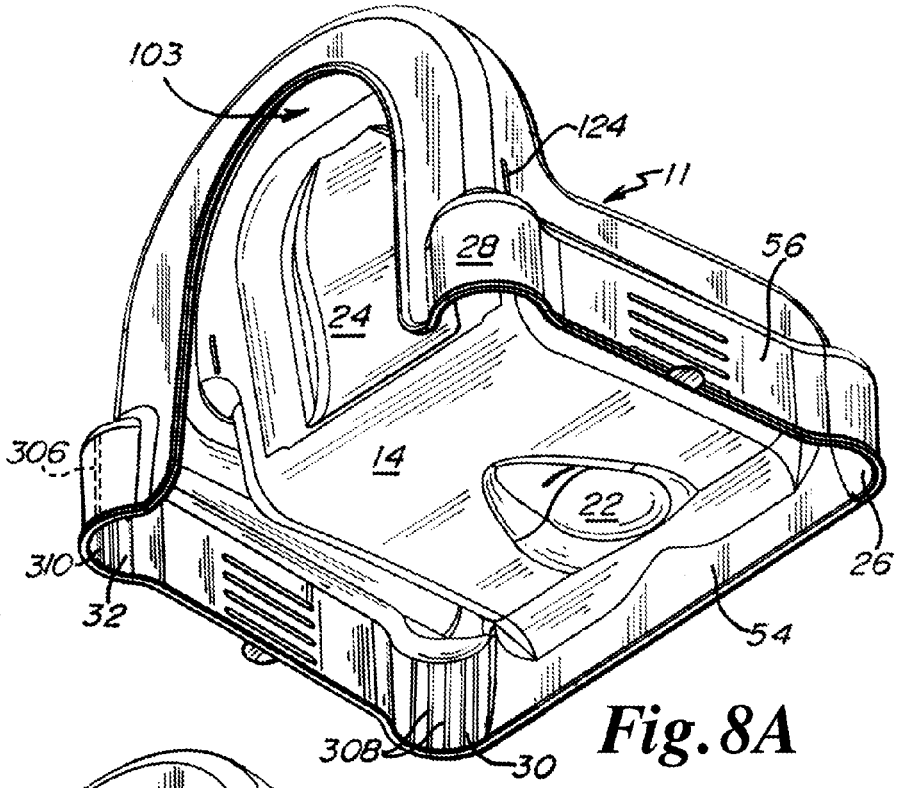
FIG. 8A is a perspective bottom view of the booster seat of FIG. 1 without the right side foot and without the left side foot.
Figure 8B:
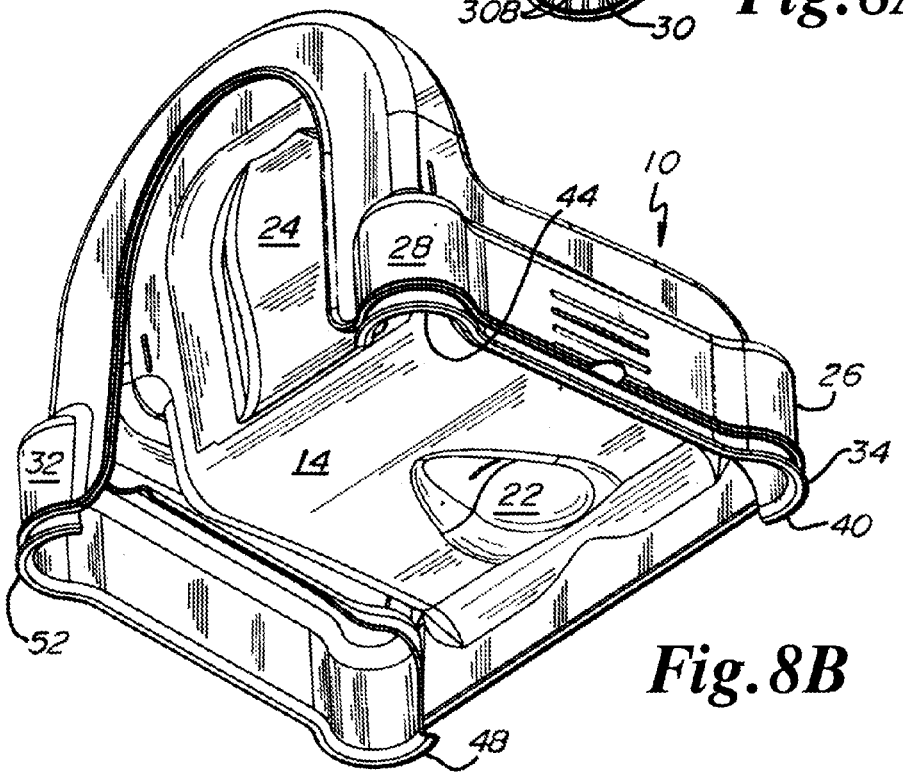
FIG. 8B is a perspective bottom view of the booster seat of FIG. 1 with the right side foot and with the left side foot.
Figure 9A:
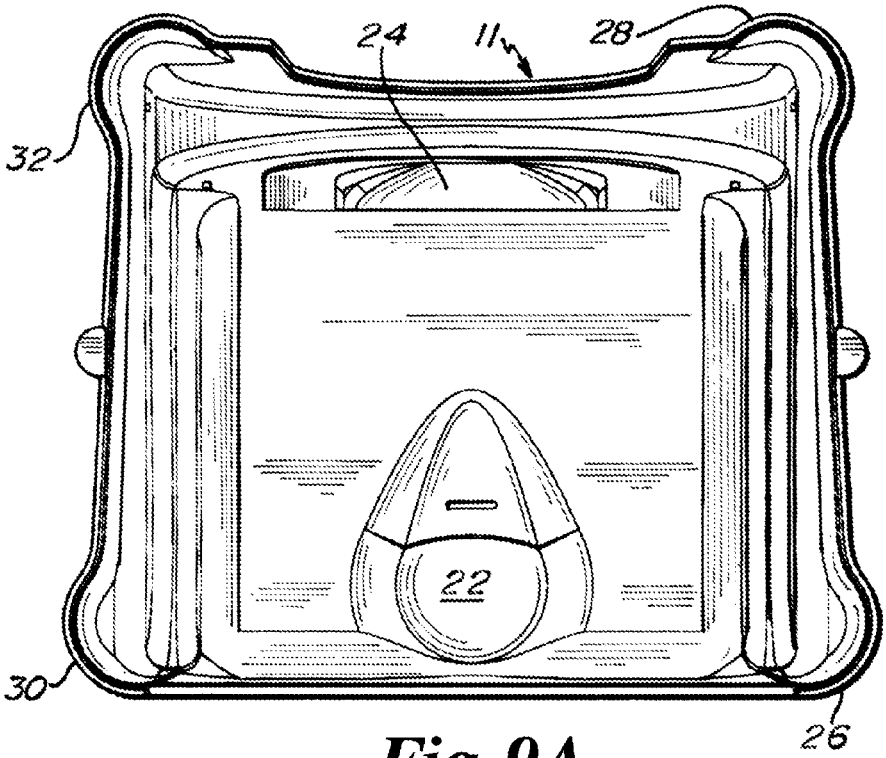
FIG. 9A is a bottom orthographic view of the booster seat of FIG. 1 without the right side foot and without the left side foot.
Figure 9B:
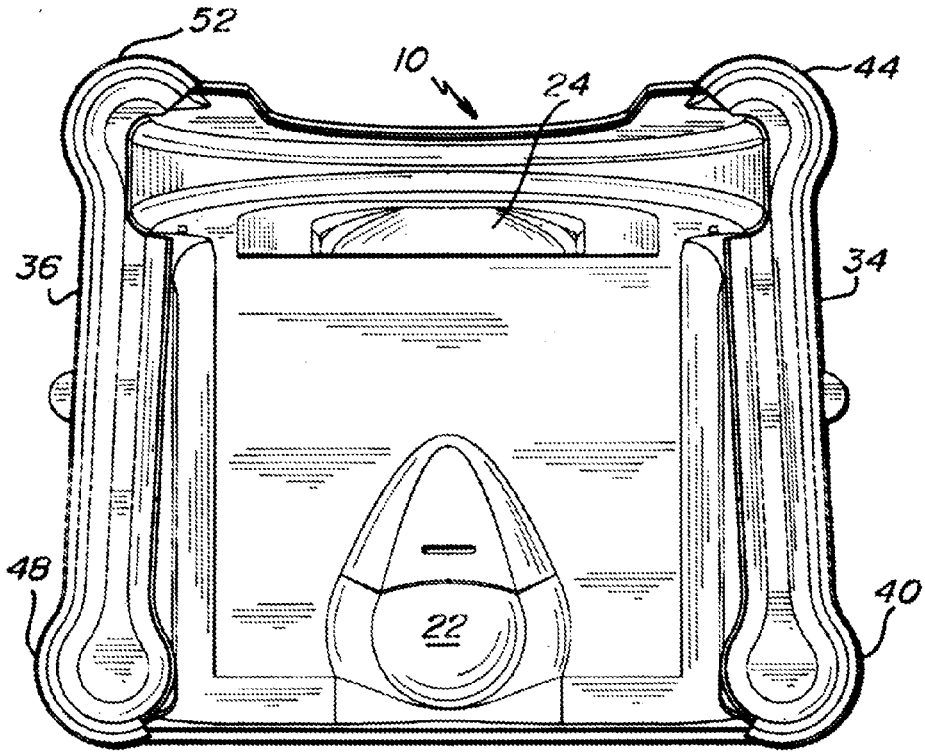
FIG. 9B is a bottom orthographic view of the booster seat of FIG. 1 with the right side foot and with the left side foot.

With more particularity, as shown in FIG. 1, base 12 includes a front side 54 that extends generally vertically. Side 54 extends to and between front corner portions 26, 30. Base 12 further includes a right side 56, shown in FIG. 8A, that extends generally vertically. Side 56 extends to and between right corner portions 26, 28. Base 12 further includes a left side 58 that extends generally vertically. Side 58 extends to and between left corner portions 30, 32. A rear side 60 of the base 12 is open. Rear corner portions 28, 32 are interconnected by back 16 instead of a side or sidewall. Base 12 can be referred to as a three sided base with an open fourth side or a four sided base where the back 16 makes up the fourth wall.

Figure 5A:
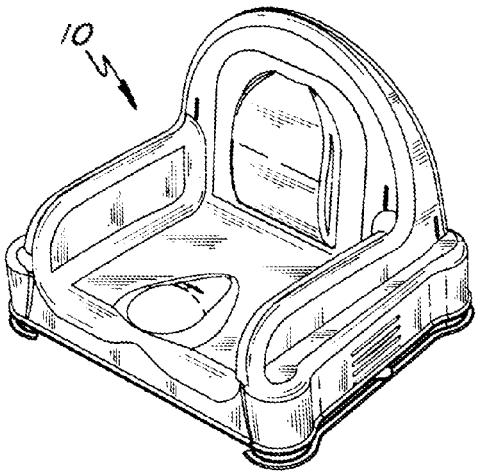
FIG. 5A is a perspective view of the booster seat of FIG. 1 reproduced on a smaller scale for comparison to the rear side elevation view of FIG. 5B.
Figure 5B:
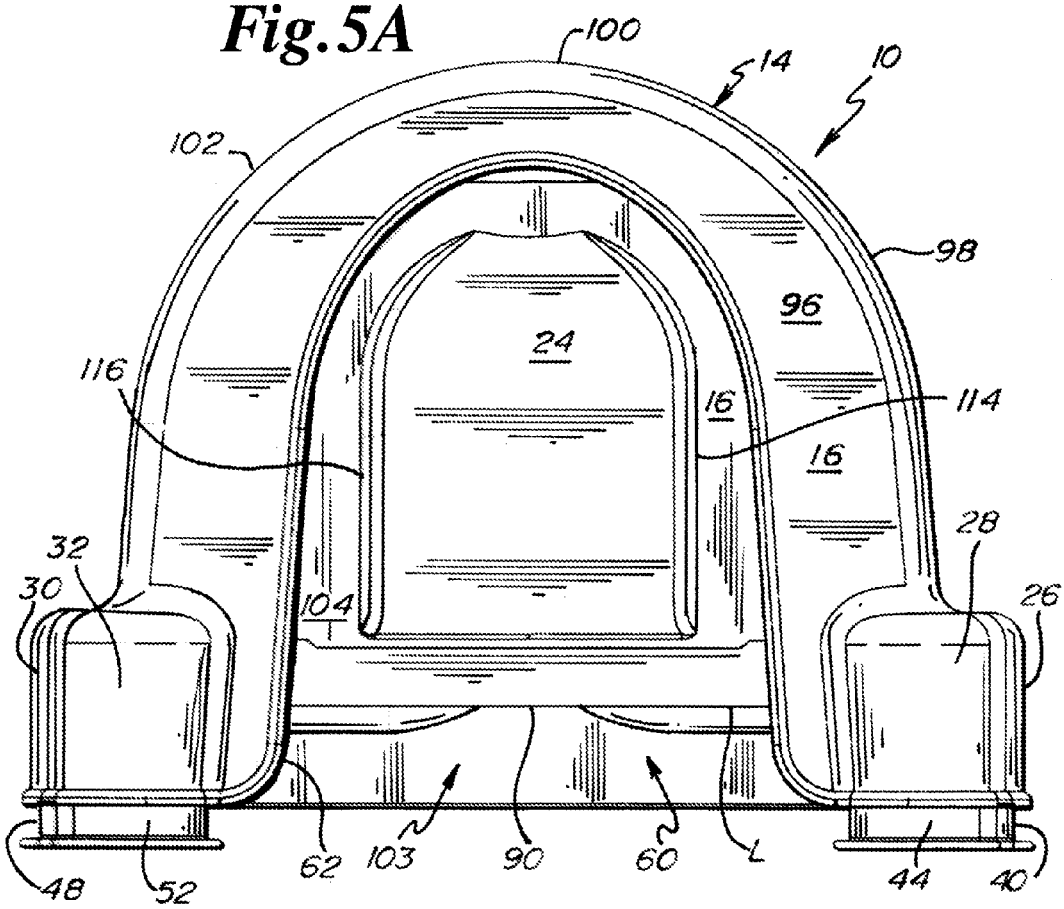
FIG. 5B is a rear side elevation view of the booster seat of FIG. 5A.

An integral flange 62 runs about a perimeter of the base 12. Flange 62 extends outwardly at generally a right angle to sides 54, 56, 58 and also extends outwardly at generally a right angle to the at least partially cylindrical corner portions 26, 28, 30, 32. Flange 62 provides an increased surface area to abut the environmental surface on which the base 12 rests when the feet 34, 36 are not employed. The sections of the flange 62 extending from sides 54, 56, 58 and corner portions 26, 28, 30, 32 lie in a common plane and thus three points on these sections, such as a point on each of sides 54, 46, 48, lie in such common plane. Flange 62 also serves to increase the stiffness of sides 54, 56, 58 and corner portions 26, 28, 30 and 32. It should be noted that flange 62 is endless. That is, as shown in FIG. 5B, flange 62 runs out of corner portion 32, runs into back 16 and therewith forms opening 60, and then runs back into corner portion 28.

Each of right side 56 and left side 58 includes formed therein a set of four horizontally and longitudinally extending slots 64. Slots 64 are disposed vertically relative to each other. Slots 64 are formed generally medially between their respective sets of corner portions 26, 28 and 30, 32.

Each of right side 56 and left side 58 includes a tab 66 extending outwardly from flange 62 at a location generally medially between respective sets of corner portions 26, 28 and 30,32. Tab 66 has the indicia "pull" thereon. When a user grips tab 66 between a thumb and forefinger and pulls, the respective side 56 or 58 is drawn outwardly. A user may pull tabs 66 both at the same time and draw out sides 56 and 58 at the same time. Tab 66 is integral with base 12.

A right convex stacking surface 68 runs from the top of right front corner portion 26, along the top of right side 56, and over the top of right rear corner portion 28. A left convex stacking surface 70 runs from the top of left front corner portion 30, along the top of left side 58, and over the top of right rear corner portion 32. The convex stacking surfaces 68, 70 follow the curvature of the flange 62. Flange 62 of an upper second body 11 confronts the right and left stacking surfaces 68, 70 of a lower first body 11 on which is stacked the upper second body 11. This flange 62 of the upper second body 11 at the corner portions 26, 28, 30, 32 engages the convex stacking surfaces 68, 70 along an arc that runs from slightly more than 180 degrees to, at an upper end, 360 degrees. This engagement is coupled with the outwardly and downwardly taper of the convex surfaces 68, 70 to thus slightly urge the upper second body 11 apart to thus apply a resilient bite upon the lower first body 11.

It should be noted that the base 12 includes transitions 72 that provide for an overall smooth surface for the base 12. These transitions 72 run from curved portions to straight portions. One transition 72 runs from curved corner portion 30 to generally planar side 58. Flange 62 and convex stacking surfaces 68, 70 also have these transitions 72.

Right side arm 18 and left side arm 20 are double walled, whereas front side 54, right side 56, left side 58, partially cylindrical corner portions 26, 28, 30, 32 are single walled. That is, each of arms 18 includes an outer wall 74 and an inner wall 76. Walls 74, 76 are generally vertical and run longitudinally, from front to back, like right and left sides 56, 58 of base 12. Walls 74, 76 run upwardly into a convex junction 78, which travels from seat 14 in the forward direction to taper downwardly and forwardly into a respective front corner portion 26 or 30 and into front side 54. A longitudinal running concave transition 80 is disposed between a respective convex stacking surfaces 68, 70 and outer wall 74. A concave transition 82 is disposed between inner wall 76 and back 16, between inner wall 76 and seat 14. Right side arm 18 and left side arm 20 minimize lateral or side to side movement of a child in the apparatus 10. Convex junctions 78 provide a resting surface for the hands and or arms of a child and provide a pushing surface for the hands of the child as the child is pushing himself or herself up and out of the apparatus 10.

Seat 14 includes a convex transition 84 running laterally from generally right side arm 18 to left side arm 20 and in the longitudinal direction leads forwardly into front side 54 and rearwardly into front seat portions 85, each of which is disposed between safety bump 22 and side arms 18, 20. Seat 14 includes a right portion 86 disposed between safety bump 22 and right side arm 18. Seat 14 includes a left portion 88 between safety bump 22 and left side arm 20. Seat 14 includes a rear portion 90 disposed between the safety bump 22 and back 16. Front seat portions 85, right and left seat portions 86, 88, and rear seat portion 90 are generally flat and smooth and lie in a common plane with each other.

Figure 2A:
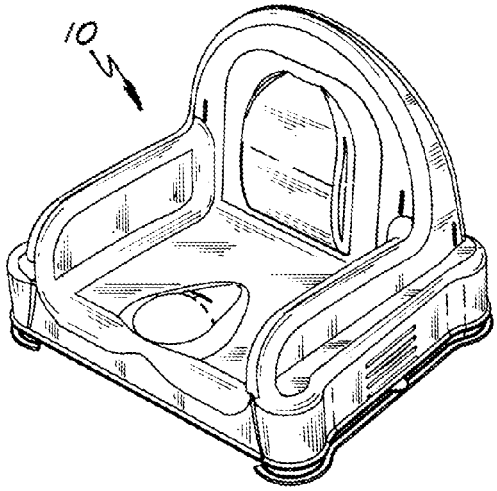
FIG. 2A is a perspective view of the booster seat of FIG. 1 reproduced on a smaller scale for comparison to the left side elevation view of FIG. 2B.
Figure 2B:
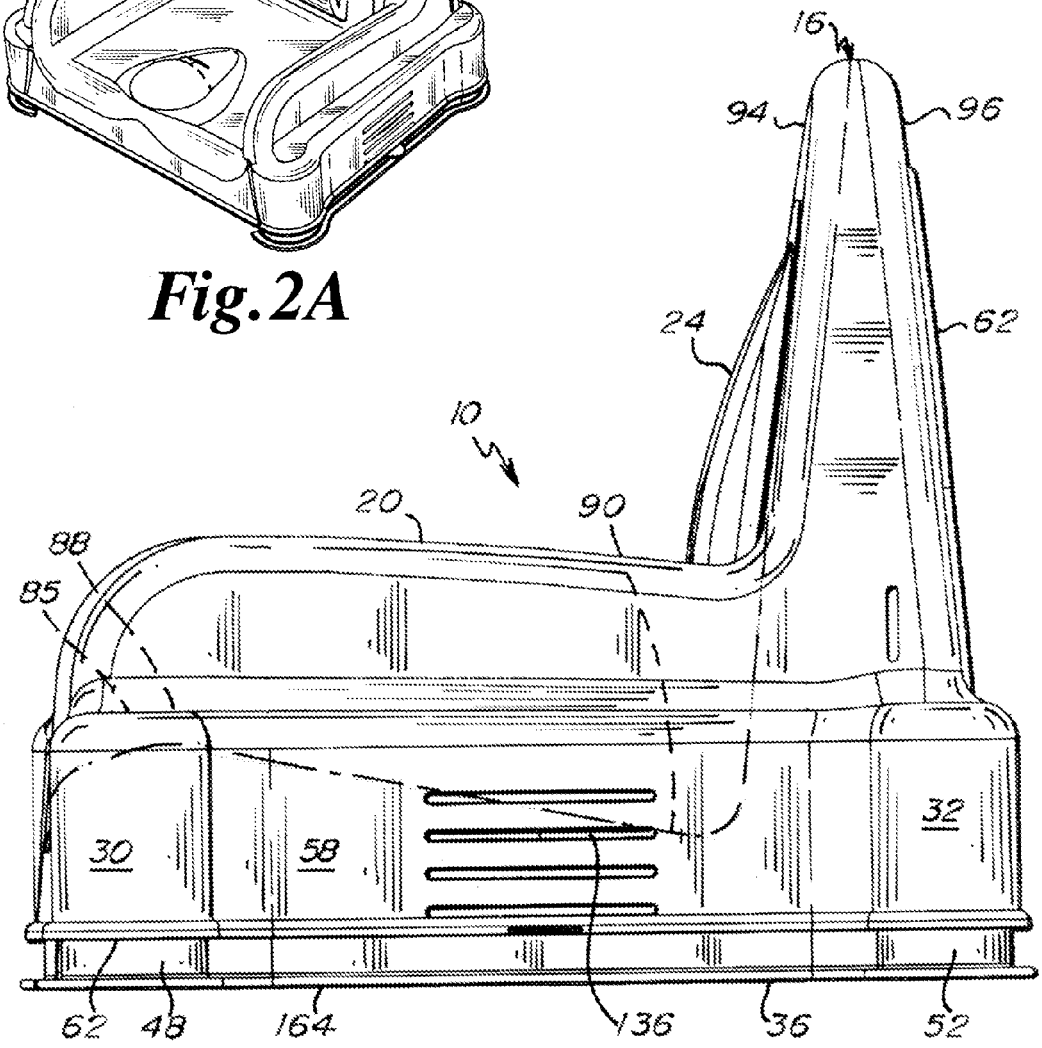
FIG. 2B is a left side elevation view of the booster seat of FIG. 2A.
Figure 3A:
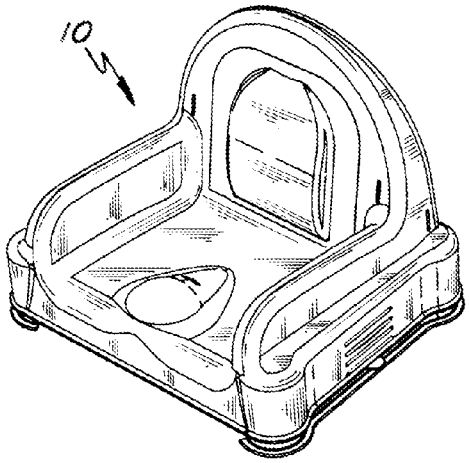
FIG. 3A is a perspective view of the booster seat of FIG. 1 reproduced on a smaller scale for comparison to the front side elevation view of FIG. 3B.
Figure 3B:
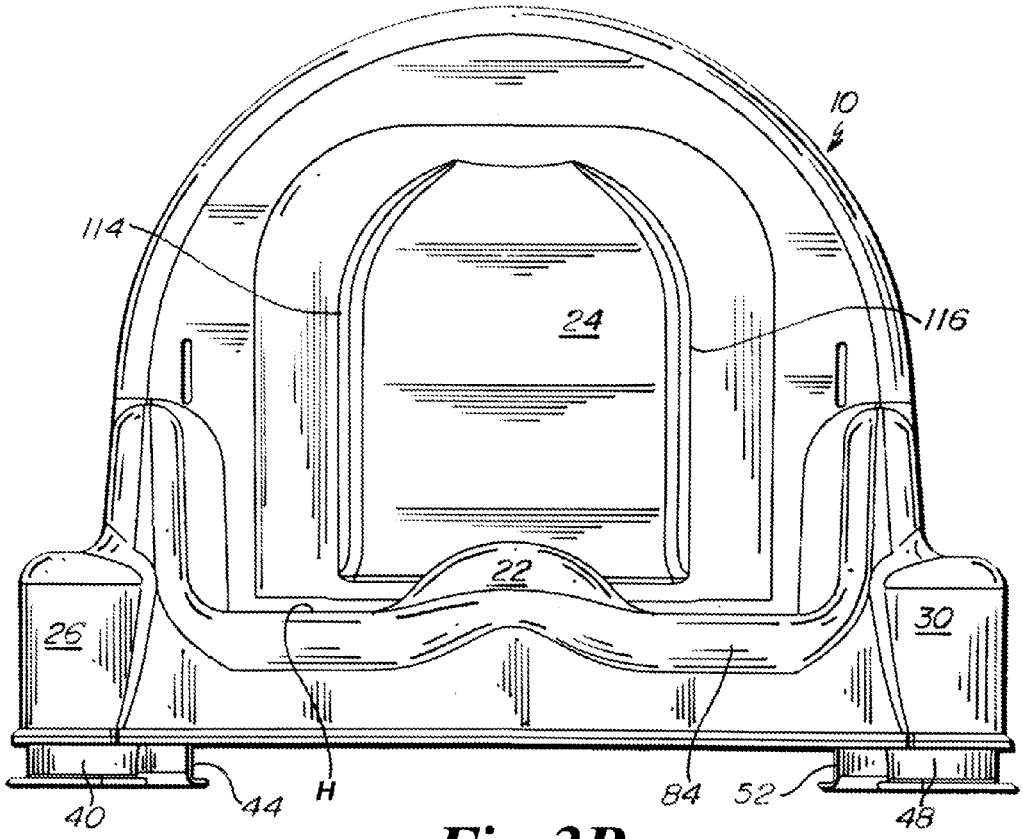
FIG. 3B is a front side elevation view of the booster seat of FIG. 3A.

As shown in phantom in FIG. 2B, seat 14 is angled downwardly and rearwardly. In other words, the forward most sections of front portions 85 are disposed at a greater distance than rearward most sections of rear portion 90 from the plane in which flange 62 lies such that the front portions 85, right portion 86, left portion 88 and rear portion 90 angle rearwardly and downwardly such that gravity tends to draw the buttocks of a child rearwardly away from safety bump 22 and such that gravity tends to draw the back of the child against the lumbar support 24 to thereby retain the child safely in the apparatus 10 and to maximize good posture. This rearward angle of seat 14 is further shown by a comparison of FIG. 3B, showing a front view, with FIG. 5B, showing a rear view. In FIG. 3B, an upper portion of transition 84 is indicated by the reference character H standing for 'high." In FIG. 5B, the inner lowermost portion of rear portion 90 is indicated by the reference character L standing for "low." A comparison of the location of reference characters H and L with features common to FIGS. 3B and 5B illustrates the rearward slope of seat 14.

Safety bump 22 is generally formed in the shape of a teardrop. Safety bump 22 is spaced from front portions 85, right portion 86, left portion 88, and rear portion 90 by a concave transitional perimeter. Safety bump 22 itself includes a convex outer surface. Safety bump includes a forwardly disposed partially spherical portion and a rearwardly disposed tapering portion. Safety bump 22 is higher in a front portion and lower in a rear portion. Safety bump 22 is wider in the front portion and lower in the rear portion.

Back 16 is double walled. As shown in FIG. 2B, back 16 includes a front wall or face 94 and a rear wall or face 96. Front wall 94 tapers upwardly and rearwardly. Rear wall 96 tapers upwardly and frontwardly. Back 16 includes a right side 98 that tapers upwardly and inwardly from the corner portion 28 to an apex 100 of the back 16. Back 16 includes a left side 102 that tapers upwardly and inwardly from corner portion 32 to apex 100.

As shown in FIG. 5B, rear wall 96 extends from corner portion 28 to corner portion 32 and forms an inverted U-shape. A lower section of rear wall 96 extends into lower sections of corner portions 28, 32. Rear wall 96 includes flange 62.

Front wall 94 of seat 14 extends into inner walls 76 of side arms 18, 20. Rear wall 96 of seat 14 extends into outer walls 74 of side arms 18, 20 through the rear corner portions 28, 32.

Front and rear walls 94, 96 form a receptacle 103 for the receipt of a back 16 of another apparatus 10. Features of the walls 94, 96 that permit such receipt for stacking of apparatus 10 include the taper of the front and rear walls 94, 96 and the taper of the sides 98, 102.

Front wall 94 includes the lumbar support 24. Front wall 94 further includes first inner nonlumbar portion 104 confronting the lumbar support 24 and a second outer nonlumbar portion 106 spaced from lumbar support 24. Portions 104, 106 surround the entirety of the lumbar support 24. Portion 104 abuts a periphery of the lumbar support 24. Lumbar support 24 includes a depth and projects forwardly of the nonlumbar portions 104, 106.

Lumbar support 24 has a height (or generally vertical length) that is less than the height of back 16. Lumbar support 24 has a width that is less than the width of back 16.

Lumbar support 24 includes a middle portion 108 and an upper portion 110. A depth of the middle portion 108 is greater than a depth of the upper portion 110. Lumbar support 24 tapers in a curvilinear fashion rearwardly and upwardly from the middle portion 108 to the upper portion 110 of the lumbar support.

Lumbar support 24 further includes a lower portion 112. A depth of the middle portion 108 is greater than a depth of the lower portion 112. Lumbar support 24 tapers in a curvilinear fashion rearwardly and downwardly from the middle portion 108 to the lower portion 112.

The taper or upper taper from the middle portion 108 to the upper portion 110 is a more gradual taper than the taper or lower taper from the middle portion 108 to the lower portion 112. In other words, this lower taper has a greater slope than such upper taper.

As shown in FIGS. 3B and 5B, lumbar support 24 further includes right and left sides 114, 116 that taper inwardly and forwardly from the nonlumbar portion 104.

Body 11 may include provisions, such as slots, for engagement of straps. These slots include generally vertically extending right strap slot 118 and generally vertically extending left strap slot 120 formed in nonlumbar portion 106 of back 16. These slots further include generally horizontally extending safety bump strap slot 122 formed in safety bump 22. These slots still further include generally vertically extending right strap slot 124 and generally vertically extending left strap slot 126.

Straps running forwardly from slots 118, 120 and rearwardly from slot 122 may be joined together by a buckle to engage the torso of a child. Straps running rearwardly from slots 124 and 126 can run around the back of an adult chair or kitchen chair and be engaged to each other with a buckle. If desired, generally horizontally extending strap slots can be formed in sides 56, 58 to wrap around the seat of an adult chair or kitchen chair.

Slots 118 and 120 are vertically elongate and are disposed in respective planes confronting planes in which the right side arm 18 and left side arm 20 are generally disposed. These slots 118 and 120 are also disposed at a height greater than an uppermost edge of side arms 18, 20.

Right foot 34 includes a generally flat vertical right side 128 disposed between and running into concave transition portions 130, which in turn run into at least partially cylindrical corner portions 40, 44. Left foot 36 includes a generally flat vertical left side 132 disposed between and running into concave transition portions 134, which in turn run into at least partially cylindrical corner portions 48, 52. Each of the sides 128, 132 includes a generally horizontal ridge 136 extending outwardly so as to engage one of the slots 64 of sides 56, 58 so as to provide height adjustability for the apparatus 10. Ridge 136 is a weight bearing feature and bears at least some of the weight of body 11 with or without a child in the body 11. The lateral length of ridge 136 is sufficiently long so as to safely engage one of the slots 64. The lateral length of ridge 136 is sufficiently short such that tab 66 is pulled only a reasonable distance for disengagement of ridge 136 from slot 64.

Right foot 34 includes a convex transition 138 that runs along the upper edge of right side 128, about the upper edge of cylindrical corner portion 40, and partially about the upper edge of cylindrical corner portion 44. Convex transition 138 leads into a generally flat top 140. A portion of transition 138 is cut away and a portion of top 140 is cut away so as to form a guide or guide edge 142. Guide 142 is a receptor for back 16 as one apparatus 10 is stacked upon another apparatus 10. Guide edge section 144 confronts front wall 94, guide edge section 146 confronts side 98, and guide edge section 148 confronts rear wall 96.

Left foot 36 includes a convex transition 150 that runs along the upper edge of left side 132, about the upper edge of cylindrical corner portion 48, and partially about the upper edge of cylindrical corner portion 52. Convex transition 150 leads into a generally flat top 152. A portion of transition 150 is cut away and a portion of top 152 is cut away so as to form a guide or guide edge 154. Guide 154 is a receptor for back 16 as one apparatus 10 is stacked upon another apparatus 10. Guide edge section 156 confronts front wall 94, guide edge section 158 confronts side 102, and guide edge section 160 confronts rear wall 96.

Right foot 34 includes a base flange 162 that runs from front end 38 to rear end 42 so as to run about corner portions 40, 44 and run along transitions 130 and side 128. Base flange 162 extends outwardly from corner portions 40, 44, transitions 130, and side 128 at a right angle. Base flange 162 serves to make foot 34 more rigid or more stiff.

Left foot 36 includes a base flange 164 that runs from front end 46 to rear end 50 so as to run about corner portions 48, 52 and run along transitions 134 and side 132. Base flange 164 extends outwardly from corner portions 48, 52, transitions 134, and side 132 at a right angle. Base flange 164 serves to make foot 36 more rigid or more stiff.

Each of the corner portions 40, 44, 48, 52 includes a cylindrical surface area portion that extends at least a degree or two more than 180 degrees at a lower range, to 360 degrees at an upper range. This cylindrical surface area portion is disposed in a plane parallel to flange 162 or 164 and preferably about an upper portion of the respective corner portion 40, 44, 48, 52.

Corner portion 40 of right foot 34 is received into right front corner portion 26. Corner portion 44 of right foot 34 is received into right rear corner portion 28. Corner portion 48 is received into left front corner portion 30. Corner portion 52 is received into left rear corner portion 32. Since each of the engagements between respective corner portions pair 40, 26 and pair 44, 28 and pair 48, 30 and pair 52, 32 is an engagement greater than 180 degrees, a horizontal displacement of the paired corner portions is minimized.

For example, it is easy to perceive that an annular engagement of a ring upon a finger is a 360 degree engagement. The ring may be displaced from the finger longitudinally. However, lateral displacement of the ring is minimized. The ring is laterally displaced only by the ring slicing through the finger.

A piece of jewelry that extends from zero degrees to 180 degrees about the finger will not stay on the finger. However, a piece of jewelry that extends a degree or two greater than 180 degrees has a chance to stay on the finger, especially if the finger is not one of flesh, but a machined finger or a machined corner portion or a molded corner portion that, unlike flesh, is relatively rigid. Here, with respect to cooperating corner portions that engage each other, a more than 180 degree entrapment is preferred, with a 270 degree entrapment even more preferred.

With the present apparatus 10, each of the corner portion pairs (i.e., 26, 40; 28, 44) of right foot 34 and body 11 acts independently of the other pair of the right foot 34 and body 11. Thus, movement of foot 34 in the horizontal plane relative to body 11 is minimized. Likewise, each of the corner portion pairs (i.e. 28, 48; 32; 52) of left foot 36 and body 11 acts independent of the other pair of the left foot 36 and body 11. Thus, movement of foot 34 in the horizontal plane relative to body 11 is minimized.

When an apparatus 10 is stacked upon another apparatus 10, flanges 162, 164 of feet 34, 36 confront the right and left stacking surfaces 68, 70 of a lower first body 11. Each of these flanges 162, 164 of feet 34, 36 at the corner portions 40, 44, 48, 52 engages the convex stacking surfaces 68, 70 along an arc that runs from slightly more than 180 degrees to, at an upper end, 360 degrees. This engagement is coupled with the outwardly and downwardly taper of the convex surfaces 68, 70 to thus slightly urge apart the feet 34, 36 and upper apparatus 10 as a whole to thus apply a resilient bite upon the lower first body 11.

Figure 6A:
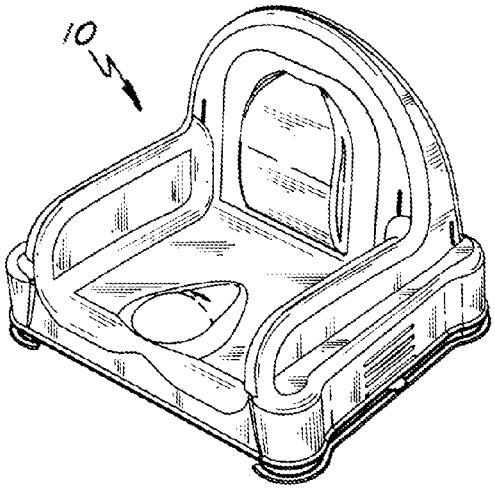
FIG. 6A is a perspective view of the booster seat of FIG. 1 reproduced on a smaller scale for comparison to bottom orthographic view of FIG. 6B.
Figure 6B:
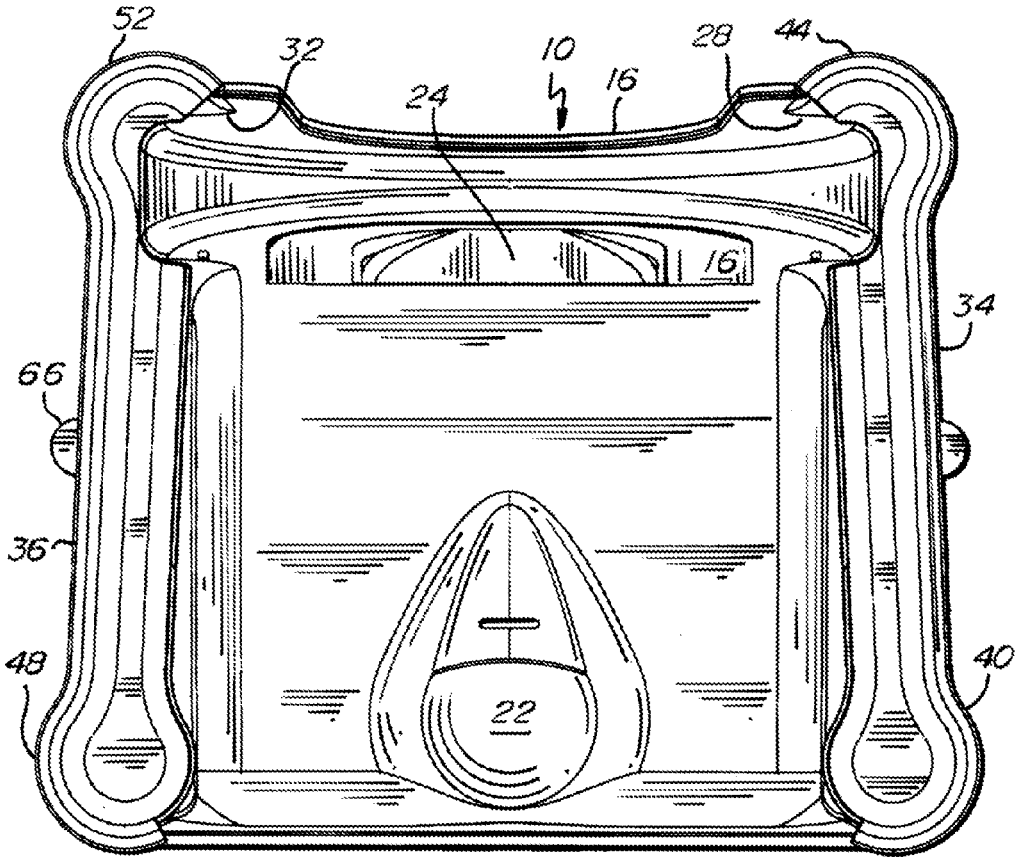
FIG. 6B is a bottom orthographic view of the booster seat of FIG. 6A.

It should be noted that body 11, with or without feet 34, 36, has an open bottom, as shown in FIG. 6B. Without feet 34, 36 engaged, body 11 is open laterally from flange 62 of right side 56 to flange 62 of left side 58 and body 11 is open longitudinally from flange 62 of front side 54 to the lower portions of rear wall 96. With feet 34, 36 engaged, such an open bottom remains generally the same because feet 34, 36 have inner walls that are minimized. Feet 34, 36 generally do not include inner walls. Feet 34, 36 generally do not include a counterpart to wall or side 128, 132. Walls 128, 132 are upright generally planar walls.

It should be noted that body 11 has an open back. Open rear side 60 provides such an open back. Open rear side 60 extends vertically from the plane of flange 62 of sides 56, 58 upwardly to the apex of flange 62 of rear wall 96. Open rear side 60 extends laterally from one lower portion of wall 96 to another lower portion of wall 96. Generally, open rear side 60 extends from corner portion 28 to corner portion 32.

It should be noted that body 11 and each of feet 34, 36 is formed of a skin. This skin is a plastic molded relatively rigid skin. Since body 11 and feet 34, 36 exist in the nature of a skin, outer features of body 11 and feet 34, 36 match their respective inner features. In other words, whereas safety bump 22 is convex relative to an outer view of body 11, safety bump 22 is concave relative to an inner view of body 11. In still other words, outer and inner surfaces of body 11 and feet 34, 36 that directly oppose each other through the plastic skin run parallel to each other throughout body 11 and feet 34, 36. Body 11 is integral and one-piece. Body 11 is a single component integral body. Right foot 34 is integral and one-piece. Right foot 34 is a single component integral body. Left foot 36 is integral and one-piece. Left foot 36 is a single component integral body.

It should be noted that the sides of the body 11 take on a cylindrical-rectangular-cylindrical shape. Feet 34, 36 also take on the cylindrical-rectangular-cylindrical shape. The cylinders, or the at least partially cylindrical corner portions of the body 11 and feet 34, 36 provide stability to the apparatus 10 as a whole by, for example, aligning four "z" or gravity axes of the body 11 with the "z" axis or gravity axis of the feet 34, 36.

It should be noted that the seat 14 and the back 16 are preferably disposed at an obtuse angle (an angle that is greater than ninety degrees). This obtuse angle is preferably between about 91 and about 100 degrees, more preferably between about 91 and about 95 degrees. It should be noted that the lines in the Figures show changes in the contours of the surfaces of the elements of the body 11 and feet 34, 36.

It should be noted that side arms 18 and 20 are disposed generally parallel to each other. It should be noted that feet 34, 36 are set at a slight angle to each other when engaged with body 11. In other words, each of right corner portions 26 and 28 of body 11 has a vertical or "z" or gravity axis and these axis lie in a common right plane. Each of left corner portions 30 and 32 of body 11 has a vertical or "z" or gravity axis and these axis lie in a common left plane. These right and left planes do not lie parallel to each other. Instead, the distance between these right and left planes at rear corner portions 28 and 32 is less than the distance between these right and left planes at front corner portions 26, 30. This relationship can be seen in FIGS. 3B, 4B, 5B and 6B.

The molding process for body 11 and feet 34, 36 can be a straight pull injection molding process.

In operation, apparatus 10 (or body 11 having right foot 34 and left foot 36 engaged thereto) is lifted and placed on the seat of an adult chair. Then right and left tabs 66 are pulled outwardly in the lateral direction, thereby pulling out the right and left sides 56, 58 and pulling slots 64 out of engagement with ridges 136 of feet 34, 36. Then body 11, via tabs 66, can be lifted upwardly or pushed downwardly to adjust the height of seat 14 relative to feet 34, 36 and relative to the seat of the adult chair. After seat 14 is disposed at the desired height, straps extending from slots 124, 126 are engaged about the back of the adult chair. Then a child can be lifted up and placed in the apparatus 10, with the buttocks of the child on seat 14 and the back or lower back of the child against the lumbar support 24. Since the seat 14 is in the nature of a slight slide, the buttocks of the child tends to slide away from safety bump 22 and toward the lumbar support 24. Then straps extending from slots 118, 120, and 122 may be engaged to in turn engage the child around his or her torso and between his or her legs.

As the child sits in the apparatus 10, apparatus 10 is safe and sturdy. One feature contributing to a safeness and sturdiness of the apparatus 10 is that the apparatus 10 has four separate and individually functioning posts at the four corners of the apparatus 10. These four posts are the four respective pairs of at least partially cylindrical corner portions pairs, i.e., pair 40 and 26, pair 44 and 28, pair 48 and 30, and pair 52 and 32. Disengagement of any of the corner portions from its respective paired corner portion is minimized because of an engagement that takes place of over more than 180 degrees. Disengagement is even further minimized because two posts (or two pairs of corner portions) share the same foot 34 or 36 and act in concert with each other. For example, an inward lateral force upon left foot 36 will be resisted by an inner section of corner portion 30 and will further be resisted by an inner section of corner portion 32 even though, for stacking purposes, left foot 36 lacks much of a right side (i.e., there is little if any wall to oppose wall or side 132) such that left side arm 20 can be received. Likewise, an inward lateral force upon right foot 34 will be resisted by an inner section of corner portion 26 and will be further resisted by an inner section of corner portion 28 even though, for stacking purposes, right foot 34 lacks much of a left side (i.e., there is little if any wall to oppose wall or side 128) such that right side arm 18 can be received.

Figure 10:
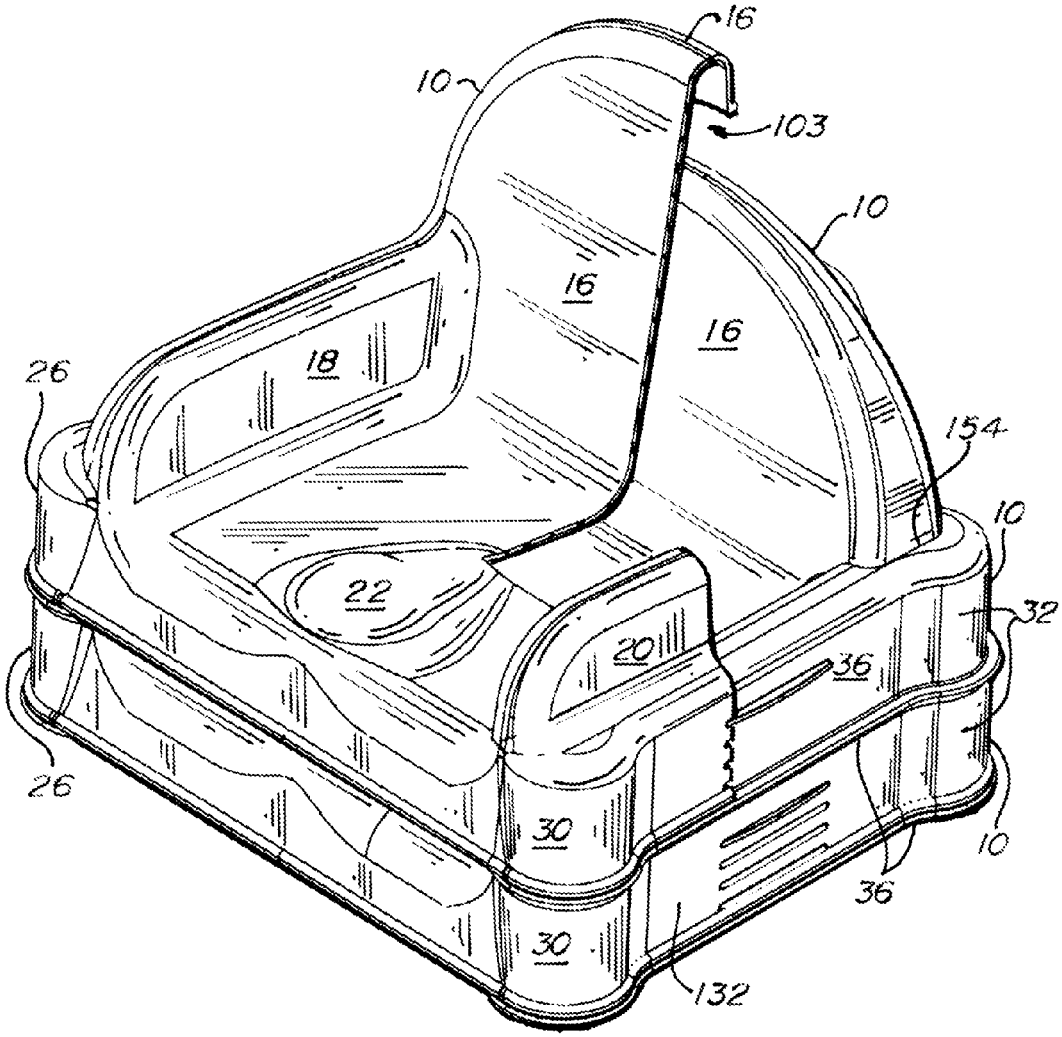
FIG. 10 is a perspective, partially section view of a first booster seat of FIG. 1 stacked upon a second booster seat of FIG. 1.

After use, apparatus 10 may be stacked with other apparatus 10, as shown in FIG. 10. Leaning is minimized by guides 142 and 154 of feet 34, 36 receiving back 16. Guide edge sections 144 and 156 minimize a forward lean. Guide edge section 146 minimizes a lean to the right. Guide edge section 158 minimizes a lean to the left. Guide edge sections 148 and 160 minimize a rearward lean. Leaning is still further minimized by the double wall back 16 receiving the back 16 of the lower disposed apparatus 10. With lower inner sections of corner portions 40, 44, 48, 52 engaging upper outer sections of corner portions 26, 28, 30, 32 at stacking convex surfaces 68, 70, any tendency of the apparatus 10 to lean is even further minimized.

If desired, apparatus 10 may be stacked without feet 34, 36. In such a case, body 11 is stacked upon body 11. Here leaning is minimized by the double wall back 16 receiving the back 16 of the lower disposed apparatus 10. Leaning is also minimized with lower inner sections of corner portions 26, 28, 30, 32 engaging upper outer sections of corner portions 26, 28, 30, 32 at stacking convex surfaces 68, 70.

Figure 11A:
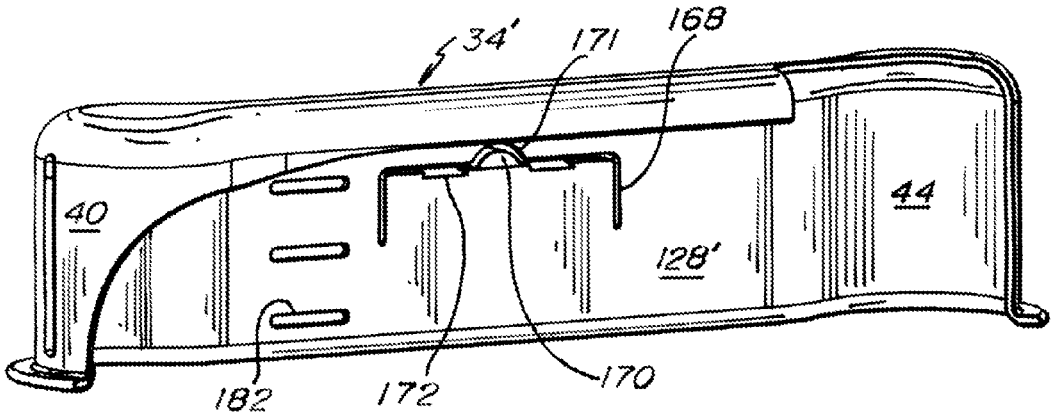
FIG. 11A is a perspective view of an alternate embodiment of the right foot of FIG. 7A, where the alternate embodiment includes locking wedges.
Figure 11B:
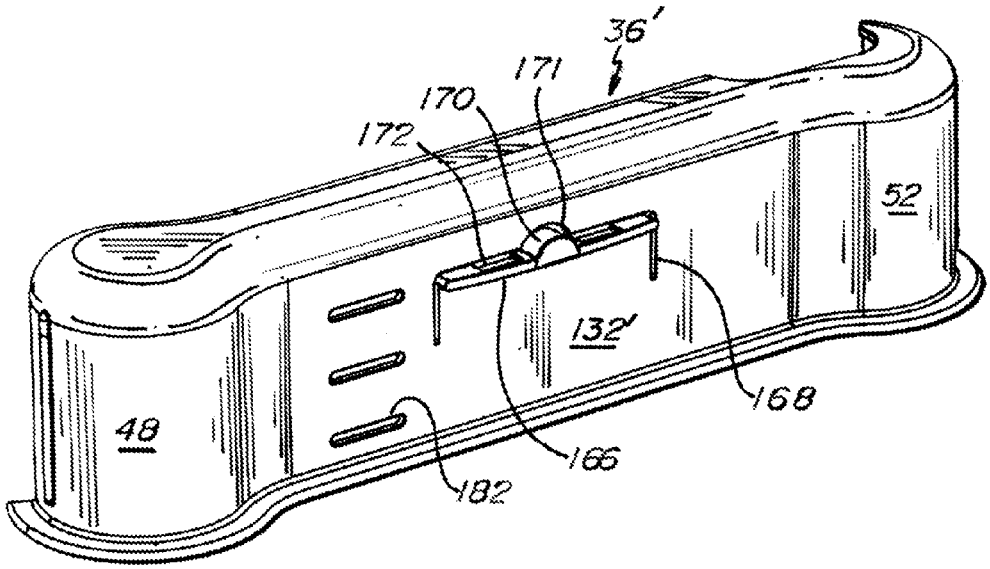
FIG. 11B is a perspective view of an alternate embodiment of the left foot of FIG. 7B, where the alternate embodiment includes locking wedges.
Figure 12A:
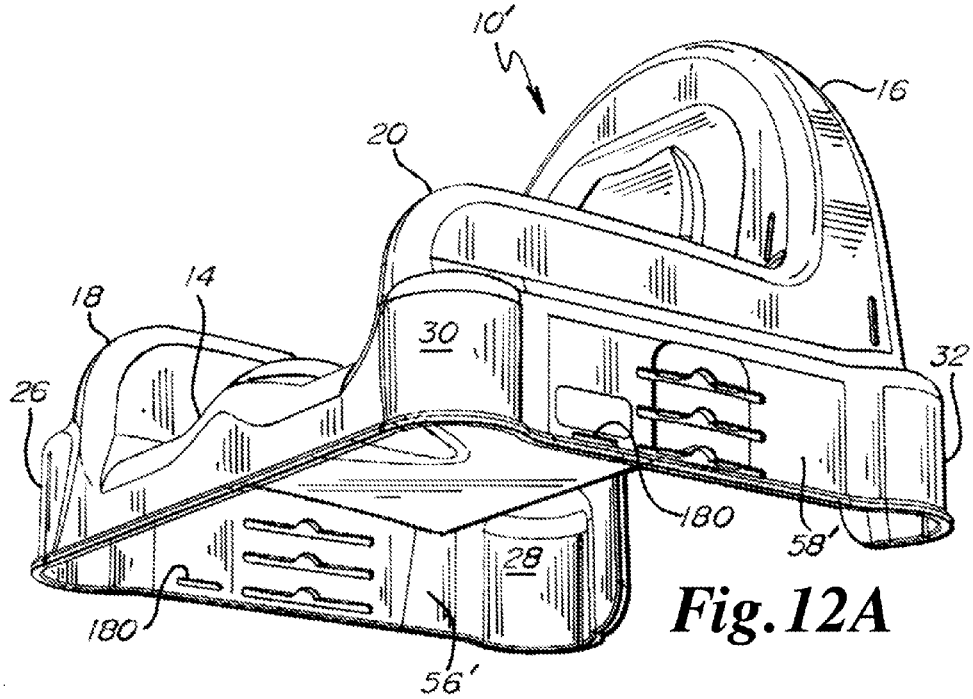
FIG. 12A is a perspective bottom view of an alternate embodiment of the body of FIG. 1.
Figure 12B:
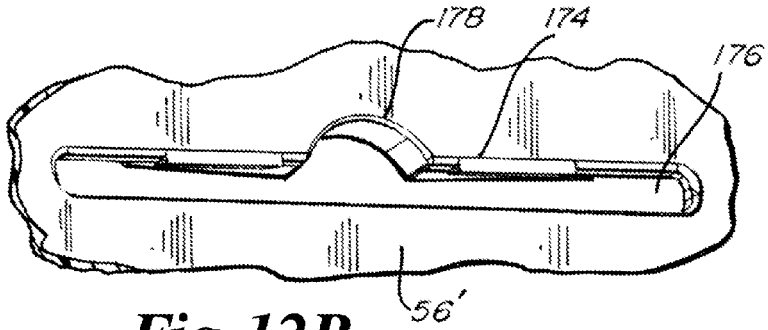
FIG. 12B is a detail isolated view of one of the slots of the right side of the body of FIG. 12A, showing such slot from the inside of the body 11.
Figure 12C:
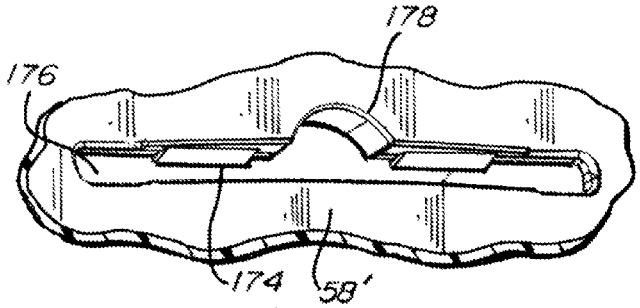
FIG. 12C is a detail isolated view of one of the slots of the left side of the body of FIG. 12A, showing such slot from the outside of the body 11.

FIGS. 11A, 11B, and 12 show an alternate embodiment 10' having feet 34' and 36'. The prime mark after a numeral means that such element, such as element 10', includes all of the features of the original element, such as element 10, except where indicated. Instead of ridge 136, each of foot 34' and 36' includes a depressible or swingable ridge 166. Ridge 166, like ridge 136, is elongate in the longitudinal direction. Ridge 166, like ridge 136, protrudes outwardly in the lateral direction. However, ridge or living hinge 166 is made depressible or swingable by virtue of an inverted U-shaped cut or slot 168 formed in side or wall 132'. Ridge 166 runs along an upper portion of the cut 168. Ridge 166 includes a tab 170 with the indicia "push" molded therein. A semi-spherical opening 171 formed in wall 132' permits tab 170 to be pushed through wall 132' to the other side of wall 132' and permits ridge 166 to be pushed inwardly and beyond a plane of wall 132'. Ridge 166 includes a pair of wedge receivers 172 formed in an upper face of ridge 166 for receiving and locking with respective wedges 174 of right side or sidewall 56' and left side or sidewall 58' of body 11. Wedges 174 protrude into slots 176 formed in sidewalls 56, 58. Slots 176 receive the elongate ridges 166. Slot 176 includes a semi-spherical opening 178 to receive tab 170. Each of the ridges 166 includes two wedge receivers 172 and each of the slots 176 confront two wedges 174. In operation, "push" tabs 170 are pushed inwardly to push ridges 166 out of slots 176 to permit the feet 56' and 58' to be adjusted vertically relative to the seat 14 or to be taken out of the body 11. 16. The generally horizontally extending and protruding ridge 166 is an integral piece of a living hinge that is in turn integral with the feet 34' and 36' such that the ridge 166 swings in and out of slot 176.

It should be noted that wedges 174 and wedge receivers 172 lock ever more tightly as greater and greater weight is placed on the body 11. Ridge 166, like ridge 136, is a weight supporting piece. Wedge receiver 172 is a four sided cavity with an inner vertical wall formed in the shape of a rectangle, a front vertical wall formed in the shape of a triangle, a rear vertical wall formed in the shape of a triangle, and an angled or ramped floor. Wedge 174 is a protrusion that conforms to the shape of the cavity and includes an inner vertical wall formed in the shape of a rectangle, a front vertical wall formed in the shape of a triangle, a rear vertical wall formed in the shape of a triangle, and an angled or ramped ceiling. When a downward force is applied to body 11, such as the weight of a child sitting in seat 14, ramped ceiling of wedge 174 brings this force upon the ramped floor of wedge receiver 172, which in turn urges the depressible ridge or living hinge or hinge panel 166 outwardly against the inner surface of each of sides 56, 58. Such a downward force also urges the inner vertical wall of the wedge 174 against the inner vertical wall of the wedge receiver. These interactions maximize locking of the feet 34' and 36' with the body 11' when a downward force is applied.

Each of right side 56' and left side 58' includes its own elongate horizontally extending ridge 180. Ridge 180 is formed on and extends inwardly from an inner face of sides 56' and 58'. Ridge 180 snaps into one of three horizontally slots 182 formed in each of feet 34' and 36' depending upon which slot 176 is cooperating with foot ridge 166. In other words, each of the feet 34' and 36' have three slots 182 and one ridge 166, while each of the sides 56' and 58' of body 11 includes three slots 176 and one ridge 180. In still other words, apparatus 10' has three height positions, a lowermost height, an intermediate height, and an uppermost height. At the lowermost height, foot ridge 166 engages the uppermost body slot 176 and body ridge 180 engages the lowermost foot slot 182. At the intermediate height, foot ridge 166 engages the middle body slot 176 and body ridge 180 engages the middle foot slot 182. At the uppermost height, foot ridge 166 engages the lowermost foot slot 176 and body ridge 180 engages the uppermost foot slot 182. The interaction between ridge 180 and its cooperating slot 182 is a snap fit interaction.

"Environmental surface" as used herein means a floor surface, the seat surface of a kitchen chair, a table top surface, a seat surface of a sofa, a carpet surface, a rug surface, or any like surface.

Figure 13A:
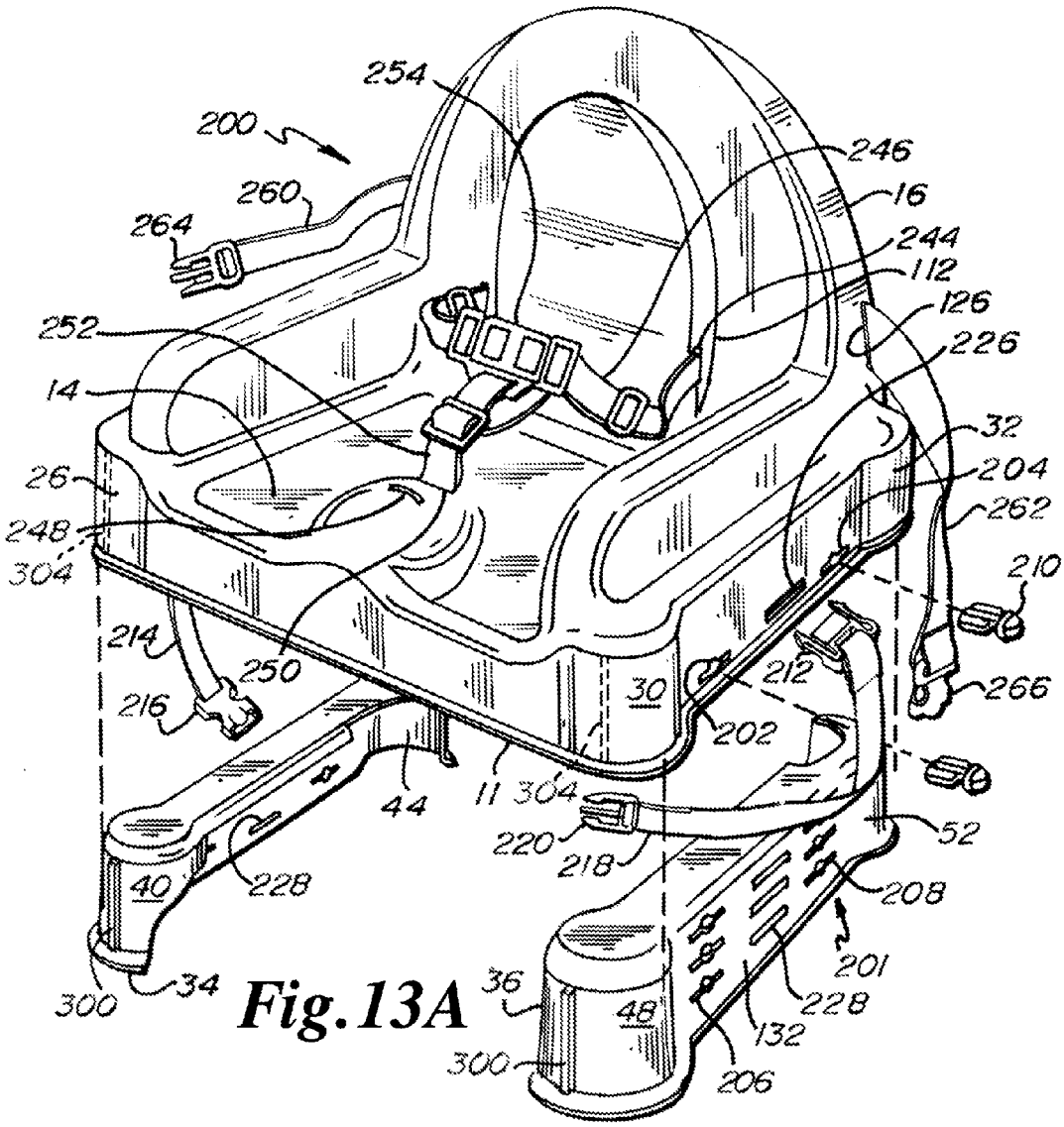
FIG. 13A is a perspective view of an improved version of the booster seat apparatus of FIG. 1.
Figure 13B:
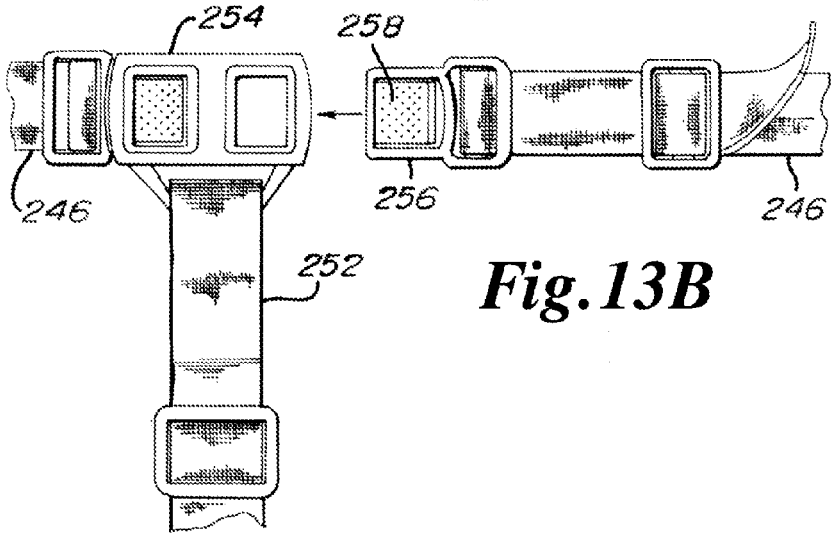
FIG. 13B is a plan view of strapping of FIG. 13A that is engaged about the waist of a toddler.

FIG. 13A shows an improved version 200 of the plastic booster seat apparatus 10 of FIG. 1. Apparatus 200 is identical to apparatus 10 with the exception of the differences described below.

Apparatus 200 retains feet 34, 36 but includes an improved engagement mechanism 201 between the body 11 and feet 34, 36. This engagement mechanism 201 includes front keyhole openings 202 and rear keyhole openings 204 in the body 11 that align and match up with respective front and rear keyhole openings 206, 208 in each of the feet 34, 36. Engagement mechanism 201 includes a set of four keys or pieces 210, one each for engaging 1) a pair of aligned keyholes 202, 206 between the body 11 and right foot 34, 2) a pair of aligned keyholes 202, 206 between the body 11 and the left foot 36, 3) a pair of aligned keyholes 204, 208 between the body 11 and the right foot 34, and 4) a pair of aligned keyholes 204, 208 between the body 11 and the right foot 34.

The engagement mechanism 201 between the body 11 and feet 34, 36 further includes a pair of squeeze latch strap anchors or pieces 212. One strap anchor 212 is engaged on a first strap 214 having a female buckle end 216. The other strap anchor 212 is engaged on a second strap 218 having a male buckle end 220. Male buckle end 220 engages female buckle end 216. Male buckle end 220 includes a pair of outer resilient prongs that are resiliently drawn inwardly as male buckle end 220 is inserted into a slot of female buckle end 216. These resilient prongs then snap outwardly when the male buckle end 220 has been fully inserted into female buckle end 216. Ends 216, 220 are disengaged from each other by pinching the resilient prongs toward each other and drawing male buckle end 220 out of female buckle end 216. Ends 216, 220 make up a quick connect and quick disconnect buckle.

Figure 15A:
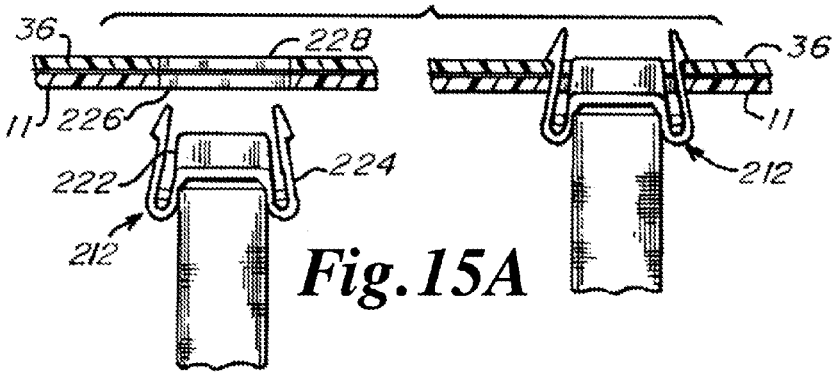
FIG. 15A is a detail step by step view of how the squeeze latch strap anchors engage the body and feet of the booster seat apparatus of FIG. 13A.

A detail of strap anchor 212 is shown in FIG. 15A. Strap anchor 212 includes a base or tab 222 that is integral and one-piece with a pair of resilient barbed prongs 224. Strap anchor 212 engages slots 226, 228. Slot 226 is formed in each of the right and left sides 56, 58 of body 11. Slot 228 is formed in each of the feet 34, 36. Upon alignment of slots 226, 228 with each other, as shown in FIG. 15A, strap anchor 212 is slid into the slots 226, 228, whereupon resilient prongs 224 are drawn together and then snap outwardly as the barbs of the prongs 224 engage the inner surface of foot 34 or 36. At this position, tab 222 also engages the slots 226, 228 and aid in minimizing vertical movement of the foot 34 or 36 relative to the body 11. To disconnect the strap anchor 212 from the slots 226, 228, the resilient prongs 224 are pinched together, such as via the heads or barbs, and the strap anchor 212 is pulled out.

Figure 15B:
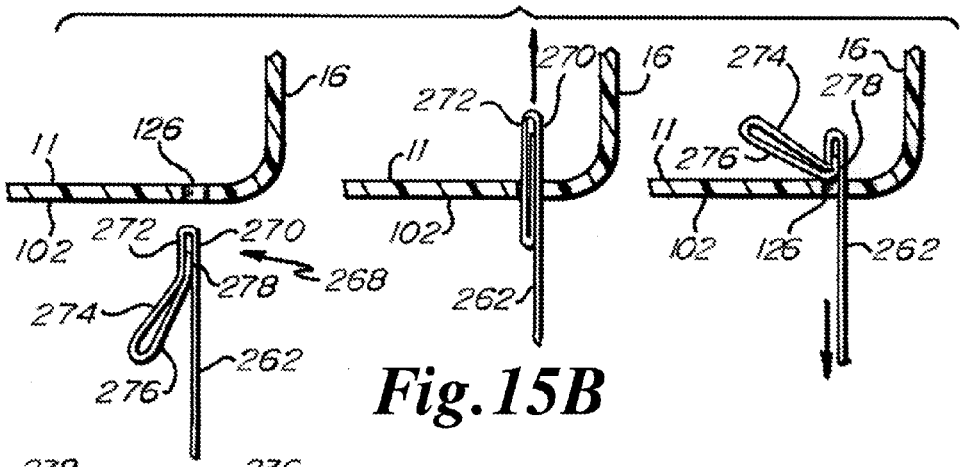
FIG. 15B is a detail step by step view of how a strap end engages the body of the booster seat apparatus of FIG. 13A.
Figure 15C:
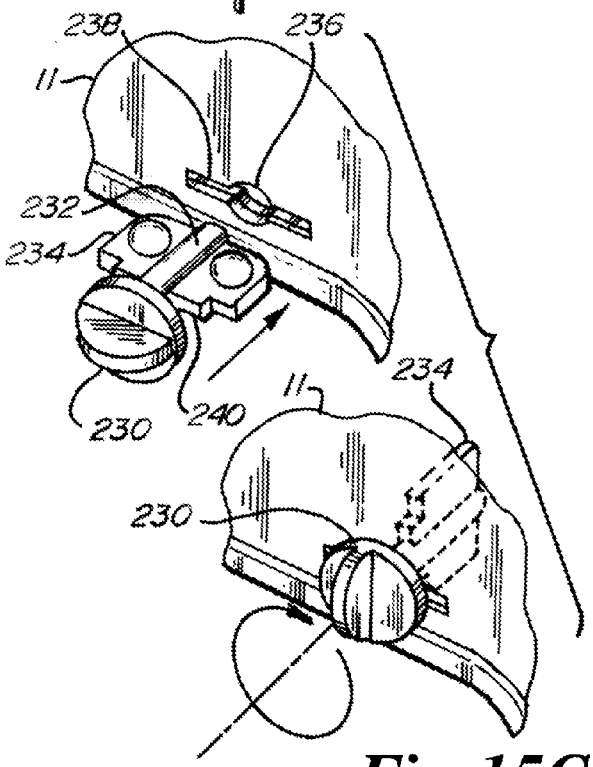
FIG. 15C is a detail step by step view of how the leg pin engages the body of the booster seat apparatus of FIG. 13A.
Figure 15D:
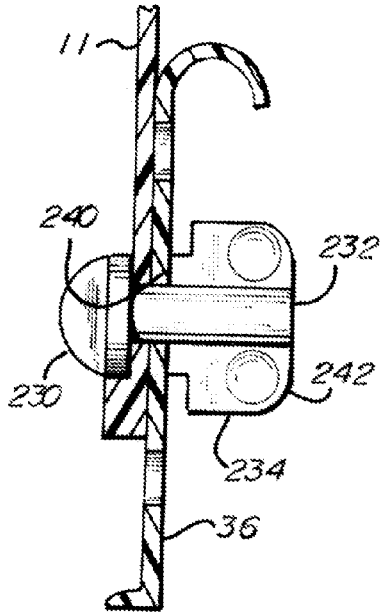
FIG. 15D is a side section detail view of the foot pin of FIG. 15C engaging the body and foot of the booster seat apparatus of FIG. 13A.

A detail of key 210 is shown in FIGS. 15C and 15D. Key 210 includes a finger knob 230 that a user pinches between his or her thumb and forefinger. Extending axially from the knob 230 is a shaft 232. Extending from the shaft 232 is a pair of wings 234 extending away from each other and away from the shaft 232. Each of keyhole openings 202, 204, 206, 208 includes a central circular opening 236 and a pair of rectilinear openings 238 extending away from each other and away from the circular opening 236. Opening 236 is sized to be slightly greater in diameter than shaft 232. Openings 238 are sized to have a slightly greater height and width than each of the wings 234. Each of the wings 234 includes an inner edge 240 extending radially from the shaft 232. Inner edge 240 abuts and locks against an inner surface of foot 34 or 36. Each of the wings 234 includes a chamfered or rounded edge 242 to facilitate entry of key 210 into rectilinear slots 238. When two keyhole openings are aligned, such as opening 202 with 206, key 210 is inserted into the aligned openings and then turned about ninety degrees such that inner edge 240 locks against the inner surface of foot 23 or 36 so as to lock the body 11 to the foot 34 or 36.

Each of the feet 34, 36 has a first set of three forward keyhole openings or slots 206 in a vertical column arrangement, a second set of three rear keyhole openings or slots 208, and a third set of slots 228. Each of the slots 206, 208, 228 extends in the longitudinal direction, i.e., forward to back. The slots 206, 208, 228 are formed in the side 128 or 132 of the respective foot 34 or 36. The slots 206, 208, 228 are formed above the bottom flange 162, 164 of the respective foot 34, 36 and below the convex transition 138, 150 of the respective foot 34, 36. The slots 206, 208, 228 are formed between the corner portions 40, 44 of right foot 34 and between the corner portions 48, 52 of the left foot 36. Each of the slots 206 is aligned horizontally with one of the slots 208. The rectilinear slot 228 between slots 206, 208 is offset relative to the slots 206, 208. That is, keyhole slots 206, 208 are set slightly higher than the rectilinear slot 228 therebetween. Slots 228 are intermediate the slots 206, 208. Each of the slots 206, 208, 228 is a through opening.

Each of slots 202, 204, 226 confronts bottom flange 62 that runs about the base 11. Each of slots 202, 204, 226 is a through opening. Slots 202, 204, 226 extends in the longitudinal direction, i.e., forward to back. Slots 202, 204, 226 are formed between the corner portions 26, 28 of the right side of the base 11 and between the corner portions 30, 32 of the left side of the base 11. Slot 226 is set closer to flange 62 than are slots 202, 204 such that slot 226 is staggered relative to slots 202, 204.

Each of feet 34, 36 are vertically adjustable in the base 11 by aligning base slots 202, 226 and 204 with one respective row of foot slots 206, 228 and 208. One key 210 may be inserted into one set of aligned keyhole slots 202, 206 and turned. Another key 210 may be inserted into the other set of aligned keyhole slots 204, 208 and turned. Strap anchor 212 may be inserted and locked into aligned slots 226, 228. In such an arrangement, foot 34 or 36 is locked by three devices to the body 11, where these three devices are a first key 210, a second key 210, and the strap anchor 212.

Apparatus 200 includes a pair of vertically extending strap slots 244 extending through the back 16. Each of the slots 244 confronts the lumbar support 24 at a lower portion 112 of the lumbar support. Each of the slots 244 engages a laterally extending strap portion 246.

Apparatus 200 includes first and second laterally extending strap slots 248, 250 in the safety bump 22. Slot 248 is placed forwardly of slot 250. Slot 248 is at or confronts the peak of the safety bump 22. Lower slot 250 is placed rearwardly of higher slot 248 and is at a lower elevation than higher slot 248. A longitudinally extending strap portion 252 engages either slot 248 or slot 250. Strap portion 252 is engaged in slot 248 for a relatively large toddler and in slot 250 for a relatively small toddler.

Strap portions 246 and 252 engage a center buckle housing 254. Each of the strap portions 246 includes a buckle tongue 256 that snaps into the center buckle housing 254. Buckle tongue 256 includes an integral button 258. Integral button 258 is resiliently biased upwardly relative to a remainder of the body of buckle tongue 256. When buckle tongue 256 slides into buckle housing 254 through a slot in the housing 254, button 258 is initially drawn downward. Then, as button 258 slides fully into buckle housing 254, button 258 snaps upwardly to lock the buckle tongue 256 to the buckle housing 254. To release the buckle tongue 256 from the buckle housing 254, the button 258 is depressed to permit the button 258 to exit the slot in the buckle housing 254. Buckle housing 254 and its buckle tongues 256 make up a quick connect and quick disconnect apparatus.

Strap portion 252 is looped around an extension of the center buckle 254 such that, when buckle tongues 256 are removed from the center buckle housing 254, center buckle housing 254 remains engaged to strap portion 252.

Figure 14A:
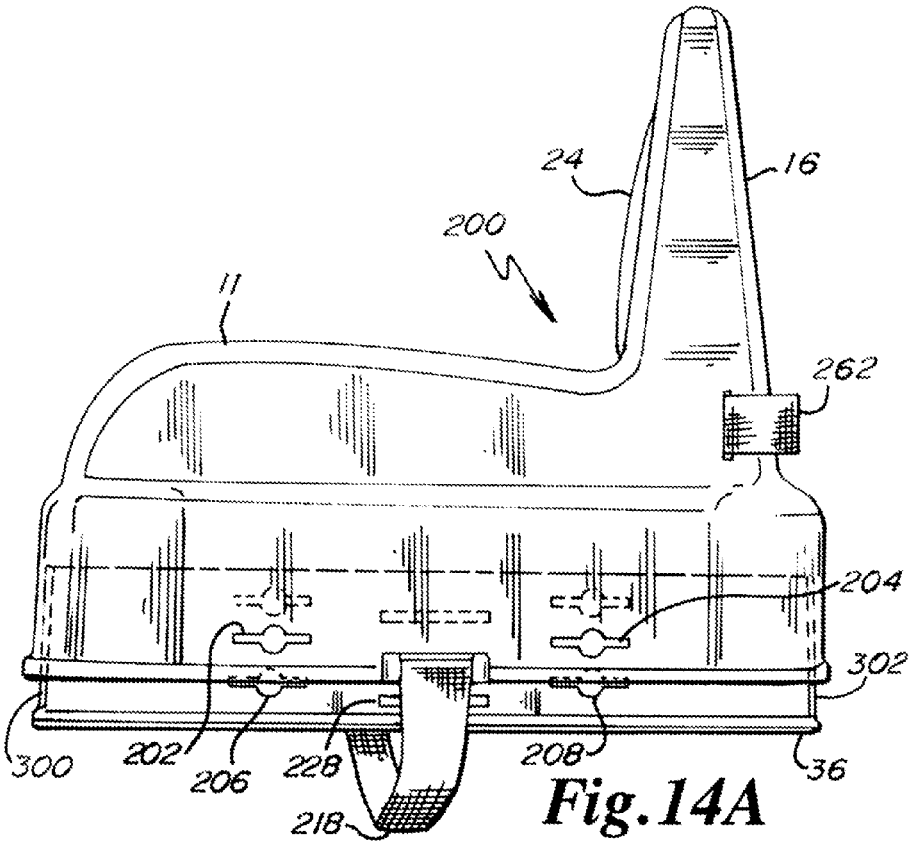
FIG. 14A is a side view of the booster seat apparatus of FIG. 13A.
Figure 14B:
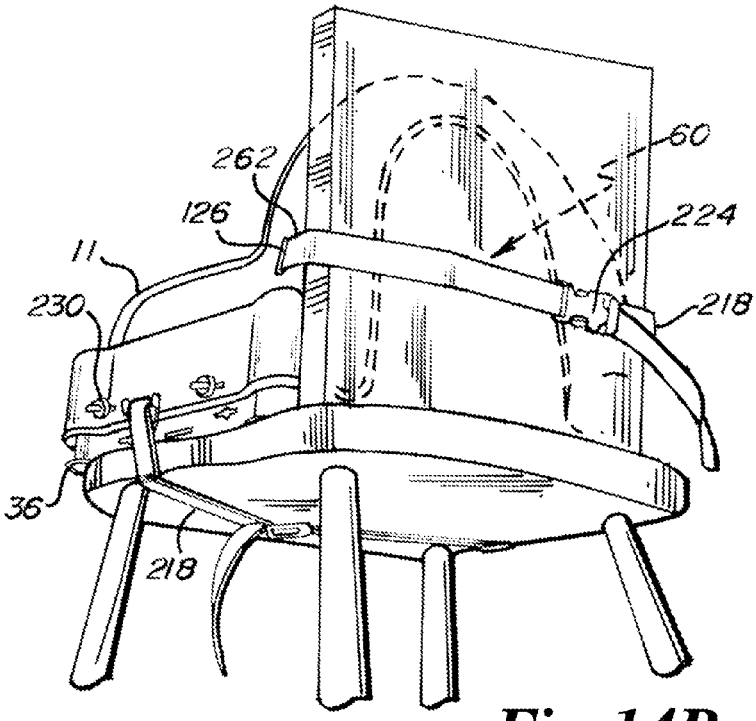
FIG. 14B is a perspective rear view of the booster seat apparatus of FIG. 13A engaged to the seat of a chair.

Apparatus 200 includes the vertically extending strap slots 124, 126 for engaging respective strap portions 260, 262. Strap portion 260 includes a male buckle end 264 and strap portion 262 includes a female buckle end 266. Strap portions 260, 262 when engaged about the back of a chair, as shown in FIG. 14A, restrict the booster seat apparatus 200 from forward longitudinal movement. Male buckle end 264 and female buckle end 266 make up a quick connect and quick disconnect apparatus, with the outer prongs of male buckle end 264 being resiliently depressable inwardly such that end 264 snaps into end 266.

As shown in FIG. 15B, a strap plug end 268 includes five strap sequential sections 270, 272, 274, 276, and 278. Each of strap portions 246, 252, 260, and 262 includes a strap plug end 268.

Sections 270 and 272 are double back sections and form a loop. Sections 274 and 276 are double back sections and form a loop. Section 278 runs from section 276 and is sandwiched between sections 270 and 272. When being inserted into a strap slot or opening, such as strap slot or opening 126, strap plug end 268 as a whole is contained within a plane. In other words, sections 270, 272, 274, 276 and 278 lie parallel to each other and confront each other. Strap plug end 268 can be removed from a strap slot or opening in such a planar state. However, after insertion, in their normal state, a pulling pressure on strap 262 pulls on strap plug end 268 at intermediate section 278, where stitching is provided through sections 278, 270 and 272. Such a pulling action flexes or bends sections 274 and 276 away from the main body of strap 262 and, as a result, the five strap sections 270, 272, 275, 276 and 278 confront opening 126 at the same time, which opening is sufficiently large to permit three strap sections to pass through, and which opening is sufficiently small to block five strap sections from passing through.

Where concave and convex structures are pointed out, such concavity or convexity is relative to the outside of the body 11 or the outside of the feet 36, 38, unless otherwise noted.

It should be noted that each of booster seat apparatus 10 and 200 may include a relatively high front and rear ridges 300, 302, formed on the exterior of the feet 34, 36, for reception in respective grooves 304, 306, formed on the interior of the body 11, to aid in the alignment of the feet 34, 36 when received in body 11. Front ridge 300 extends forwardly and vertically from its respective flange 162, 164 to its respective convex transition 138, 150. Front ridge 300 is disposed on the forward most portion of its respective corner portion 40, 48. Rear ridge 302 extends rearwardly and vertically from its respective flange 162, 164 to its respective convex transition 138, 150. Rear ridge 302 is disposed on the rearward most portion of its respective corner portion 44, 52. Each of body corner portions 26, 30 have vertically running grooves 304 formed in their inner surfaces for receiving front ridges 300. Each of body corner portions 28, 32 have vertically running grooves 306 formed in their inner surfaces for receiving rear ridges 302. Grooves 304, 306 run from flange 62 to its respective convex stacking surface 68, 70. Grooves 304, 306 are also formed in the inner edge of flange 62 itself. The inner faces of each of the body front corner portions 26, 30, have relatively low ridges 308 and the inner faces of each of the body rear corner portions 28, 32 have relatively low ridges 310. Ridges 308, 310 run vertically from flange 62 to the respective convex stacking surface 68, 70. Low ridges 308, 310 act as a roughened surface to minimize twisting of feet 34, 36 in the body 11 and to maximize a snug but releasable engagement between feet 34, 36 and body 11. Low ridges 308, 310 make contact with the smooth exterior surfaces of feet corner portions 40, 44, 48, 52.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

We claim:

1. A plastic booster seat apparatus for a child, comprising:

a) a plastic base to support the plastic booster seat apparatus relative to an environmental surface, with the plastic base having at least three points defining a plane that lies generally level with said environmental surface;

b) a plastic back for the back of the child and comprising a lumbar support;

c) a plastic seat for the buttocks of the child, wherein said plastic seat comprises:

i) a front portion that confronts an inner knee of the child, a rear portion that confronts said plastic back, a right portion, and a left portion;

ii) a safety bump between the front and rear portions and between the left and right portions, with said safety bump comprising a rise projecting upwardly from said front, rear, right and left portions, and with said safety bump confronting said front portion of said plastic seat;

iii) wherein the front portion is disposed at a greater distance from said plane than said rear portion such that said right, left and rear portions angle rearwardly and downwardly such that gravity tends to draw the buttocks of the child rearwardly away from the safety bump and such that gravity tends to draw the back of the child against the lumbar support and thereby retain the child safely in the plastic booster seat; and d) wherein said plastic back has a height and a width, wherein said lumbar support has a height, a width, and a depth, wherein the height of the lumbar support is less than the height of said plastic back, and wherein the width of the lumbar support is less than the width of the plastic back.

2. The plastic booster seat apparatus of claim 1, wherein said plastic back further comprises a non-lumbar portion, with the lumbar support projecting forwardly of the non-lumbar portion, and with the non-lumbar portion extending about the entirety of the lumbar support.

3. The plastic booster seat apparatus of claim 1, wherein said lumbar support includes a middle portion and an upper portion, wherein a depth of the middle portion of said lumbar support is greater than a depth of the upper portion of said lumbar support, and wherein said lumbar support tapers rearwardly and upwardly from the middle portion to the upper portion of the lumbar support.

4. The plastic booster seat apparatus of claim 1, wherein said lumbar support includes a middle portion and a lower portion, wherein a depth of the middle portion of said lumbar support is greater than a depth of the lower portion of said lumbar support, and wherein said lumbar support tapers rearwardly and downwardly from the middle portion to the lower portion of the lumbar support.

5. The plastic booster seat apparatus of claim 1, wherein said plastic seat further comprises a plastic right side and a plastic left side, with the plastic right side having an upper edge and with the plastic left side comprising an upper edge, with each of the upper edges running into the plastic back at a junction, with the lumbar support having an upper portion above said junction, and with the lumbar support having a lower portion below said junction.

6. The plastic booster seat apparatus of claim 1, wherein said plastic seat and plastic back are integral and one-piece with each other.

7. A plastic booster seat apparatus for a child, comprising:

a) a plastic base comprising a set of four corner portions;

b) a plastic back for the back of the child;

c) a plastic seat for the buttocks of the child;

d) a first foot and a second foot, with the first foot engaging two of the corner portions at the same time, with the second foot engaging two of the corner portions at the same time, with the first foot and with the second foot supporting the plastic booster seat apparatus relative to an environmental surface, and with each of the first foot and the second foot being disengageable from the corner portions;

e) wherein the set of four corner portions includes a right front corner portion, a right rear corner portion, a left front corner portion, and a left rear corner portion, with the first foot engaging at the same time the right front corner portion and the right rear corner portion, and with the second foot engaging at the same time the left front corner portion and the left rear corner portion;

f) wherein each of said corner portions comprises a concave stacking surface relative to an interior of the plastic booster seat apparatus, and wherein said first foot and said second foot each comprises a first end and a second end, with each of the first and second ends comprising a convex transition relative to an exterior of the feet for engaging said concave stacking surface of one of said corner portions whereby said first foot and said second foot engage the corner portions in a stable manner; and g) wherein each of said corner portions comprises a convex stacking surface relative to an exterior of the plastic booster seat apparatus, with each of the first and second ends of said first foot and second foot comprising a concave transition relative to an interior of the feet that confronts said convex stacking surface of one of said corner portions whereby one plastic booster seat apparatus is stackable and stable upon a second plastic booster seat apparatus identical in structure to said plastic booster seat apparatus.

8. The plastic booster seat apparatus of claim 7, wherein the plastic back comprises right and left sides tapering upwardly and inwardly and front and rear faces tapering upwardly and inwardly, and with the plastic back including a receptor for a plastic back of a second plastic booster seat apparatus identical in structure to said plastic booster seat apparatus.

9. The plastic booster seat apparatus of claim 7, wherein each of said first and second foot includes a rear end, with said rear end including a guide for a plastic back of a second plastic booster seat apparatus identical in structure to said plastic booster seat apparatus, whereby said plastic booster seat apparatus and said second plastic booster seat apparatus are stackable.

10. The plastic booster seat apparatus of claim 7, a) wherein each of said first and second foot includes a rear end, with said rear end including a guide for a plastic seat of a second plastic booster seat apparatus identical in structure to said plastic booster seat apparatus; and b) wherein said plastic back includes a plastic receptor that receives at least a portion of a plastic back of a second plastic booster seat apparatus identical in structure to said plastic booster seat apparatus, whereby said plastic booster seat apparatus and second plastic booster seat apparatus are stackable.

11. The plastic booster seat apparatus of claim 7, wherein said first foot and said second foot each comprises:

a) a side portion extending to and between the first and second ends; and b) a lower portion extending to and between the first and second ends, with said lower portion comprising a flange extending outwardly at generally a right angle to said side portion to stabilize said foot and therefore stabilize said plastic booster seat apparatus, with said flange extending to and between the first and second ends.

12. The plastic booster seat apparatus of claim 7, wherein said plastic seat and plastic back are integral and one-piece with each other.

13. A plastic booster seat apparatus for a child, comprising:

a) a plastic base comprising a set of four corner portions;

b) a plastic back for the back of the child;

c) a plastic seat for the buttocks of the child;

d) a first foot and a second foot, with the first foot engaging two of the corner portions at the same time, with the second foot engaging two of the corner portions at the same time, with the first foot and with the second foot supporting the plastic booster seat apparatus relative to an environmental surface, and with each of the first foot and the second foot being disengageable from the corner portions;

e) wherein one of a) said plastic body and b) said foot includes at least two slots and wherein said other of a) said plastic body and b) said foot includes at least one slot, wherein said at least two slots are oriented vertically relative to each other, wherein said at least one slot is alignable with each of said at least two slots, and further comprising a first piece engageable between one of said at least two slots and said at least one slot of the first foot and plastic body and a second piece engageable between one of said at least two slots and said at least one slot of the second foot and plastic body such that the plastic body is adjustable in height;

f) wherein each of said first and second pieces is a key and wherein each of said slots is formed in a shape of a keyhole;

g) wherein said key comprises:

i) a knob;

ii) a shaft extending axially from the knob; and iii) a pair of wings extending from the shaft, with the wings extending away from each other, with each of the wings including an inner edge that abuts and locks against a surface of said first or second foot, and with each of the wings including a rounded edge to facilitate entry of the key into the keyhole; and h) wherein said keyhole comprises a circular opening and a pair of rectilinear openings extending away from each other and away from the circular opening.

14. The plastic booster seat apparatus of claim 13, wherein said plastic seat and plastic back are integral and one-piece with each other.

15. A plastic booster seat apparatus for a child, comprising:

a) a plastic base supporting the plastic booster seat apparatus relative to an environmental surface;

b) a plastic back for the back of the child;

c) a plastic seat for the buttocks of the child;

d) wherein said plastic base further comprises a right front corner portion, a right rear corner portion, a left front corner portion, and a left rear corner portion, with each of the corner portions comprising a convex stacking surface relative to an exterior of the plastic booster seat apparatus and a concave stacking surface relative to an interior of the plastic booster seat apparatus such that said convex stacking surfaces of corner portions of a first plastic booster seat apparatus can confront concave stacking surfaces of corner portions of a second plastic booster seat apparatus identical in structure to said plastic booster seat apparatus and such that convex stacking surfaces of corner portions of said second plastic booster seat apparatus can confront concave stacking surfaces of corner portions of a third plastic booster seat apparatus identical in structure to said plastic booster seat apparatus and said second plastic booster seat apparatus, whereby said plastic booster seat apparatus, said second plastic booster seat apparatus, and said third plastic booster seat apparatus are stackable.

16. The plastic booster seat apparatus of claim 15, wherein the plastic back comprises right and left sides tapering upwardly and inwardly and front and rear faces tapering upwardly and inwardly, and with the plastic back including a receptor for a plastic back of a second plastic booster seat apparatus identical in structure to said plastic booster seat apparatus.

17. The plastic booster seat apparatus of claim 15, wherein said plastic seat and plastic back are integral and one-piece with each other.

18. A molded booster seat apparatus for a child, comprising:

a) a molded base supporting the molded booster seat apparatus relative to an environmental surface;

b) a molded back for the back of the child;

c) a molded seat for the buttocks of the child;

d) wherein said molded base further comprises a right front corner portion, a right rear corner portion, a left front corner portion, and a left rear corner portion, with each of the corner portions comprising an at least partially cylindrical outer surface and an at least partially cylindrical inner surface such that exterior corner portions of a first molded booster seat apparatus can confront interior corner portions of a second molded booster seat apparatus identical in structure to said molded booster seat apparatus and such that exterior corner portions of said second molded booster seat apparatus can confront interior corner portions of a third molded booster seat apparatus identical in structure to said molded booster seat apparatus and said second molded booster seat apparatus, whereby said molded booster seat apparatus, said second molded booster seat apparatus, and said third molded booster seat apparatus are stackable.

19. The molded booster seat apparatus of claim 18, wherein said molded seat and molded back are integral and one-piece with each other.

* * * * *